US009406468B2

(12) United States Patent
Osumi et al.

(10) Patent No.: US 9,406,468 B2
(45) Date of Patent: Aug. 2, 2016

(54) RELAY

(71) Applicant: OMRON Corporation, Kyoto-Shi (JP)

(72) Inventors: Yoshimasa Osumi, Kyoto (JP); Masayuki Shinohara, Nagaokakyou (JP); Hiroyuki Miyamoto, Shiga (JP); Kazuhide Hirota, Moriyama (JP)

(73) Assignee: OMRON CORPORATION, Kyoto-shi (JP)

( * ) Notice: Subject to any disclaimer, the term of this patent is extended or adjusted under 35 U.S.C. 154(b) by 108 days.

(21) Appl. No.: 14/311,885

(22) Filed: Jun. 23, 2014

(65) Prior Publication Data

US 2015/0015351 A1 Jan. 15, 2015

(30) Foreign Application Priority Data

Jul. 12, 2013 (JP) ..... 2013-146260

(51) Int. Cl.

| | |
|---|---|
| ***H01H 50/08*** | (2006.01) |
| ***H01H 50/06*** | (2006.01) |
| *F21V 99/00* | (2006.01) |
| *H01H 9/18* | (2006.01) |

(52) U.S. Cl.

CPC ..... *H01H 50/08* (2013.01); *H01H 50/06* (2013.01); *F21V 99/00* (2013.01); *F21V 2200/00* (2015.01); *H01H 9/182* (2013.01)

(58) Field of Classification Search

CPC ..... H01H 50/08; H01H 50/06; H01H 9/182; F21V 99/00; F21V 2200/00; F21V 2200/13; F21V 2200/20; G02B 6/00; G02B 6/0001; G02B 6/0011; G02B 6/0035; G02B 6/0036; G02B 6/0038; G02B 6/0073

See application file for complete search history.

(56) References Cited

U.S. PATENT DOCUMENTS

| | | | | |
|---|---|---|---|---|
| 3,916,133 | A * | 10/1975 | Bollinger, Jr. | H01H 9/16 200/308 |
| 4,082,934 | A * | 4/1978 | Piber | H01H 21/025 116/319 |
| 7,675,426 | B2 * | 3/2010 | Takada | H01H 50/08 324/418 |
| 2008/0224878 | A1 | 9/2008 | Takada et al. | |

FOREIGN PATENT DOCUMENTS

| | | | |
|---|---|---|---|
| EP | 1 154 452 | A1 | 11/2001 |
| JP | 2006-172731 | A | 6/2006 |

OTHER PUBLICATIONS

Extended European Search Report for EP 14 17 3678.5 dated Oct. 8, 2014. (5 Pages).

* cited by examiner

*Primary Examiner* — Bao Q Truong

(74) *Attorney, Agent, or Firm* — Nutter McClennen & Fish LLP; John J. Penny, Jr.

(57) ABSTRACT

A relay in which a relay body and a light source are incorporated in a case, the light source emitting light in conjunction with operation of the relay body, wherein a light guide is provided inside an outer surface of the case, the light guide is configured to take in the light emitted from the light source, to guide the light to a portion parallel to a top panel of the case, and to spread the light in the portion parallel to the top panel, and an optical pattern is provided in at least one of a top surface and a bottom surface of the portion parallel to the top panel, the optical pattern is configured to output, the light guided in the light guide to the portion parallel to the top panel, to outside the case from a top surface of the top panel.

16 Claims, 25 Drawing Sheets

RELAY

CROSS-REFERENCE TO RELATED APPLICATION

This application claims the benefit of priority from Japanese Patent Application No. 2013-146260, filed on 12 Jul. 2013, the entire contents of which is incorporated herein by reference for all purposes.

FIELD

The present invention relates to a relay, specifically to a relay having a function of displaying planar emitting operation.

BACKGROUND

In a conventional relay, sometimes a pilot lamp is provided in order for a worker to easily check operation of a relay. The pilot lamp is provided in an upper portion of a housing of the relay so that the worker can easily visually recognize a lighting state of the pilot lamp.

FIGS. 1A and 1B are schematic sectional view and a schematic plan view of a conventional relay 11 incorporating a pilot lamp therein. In relay 11, a relay body 13 including a coil unit and a contact unit is assembled on a top surface of base 12, and relay body 13 is covered with a transparent housing 14 attached onto base 12. A Pilot lamp 15 constructed with an LED is provided in an upper portion of transparent housing 14. Pilot lamp 15 is lit when relay 11 is in an on state, pilot lamp 15 is turned off when relay 11 is in an off state, and an operating state of relay 11 can be checked by lighting on or turning off pilot lamp 15.

Because there is a need for downsizing of the relay, there is little room to allocate a sufficient space to provide pilot lamp 15 in transparent housing 14, thus pilot lamp 15 is arranged in a gap between relay body 13 and transparent housing 14 and an optical axis of pilot lamp 15 is horizontally oriented. Therefore, in relay 11, as indicated by a broken-line arrow in FIGS. 1A and 1B, the light emitted from pilot lamp 15 is inevitably interrupted in a certain direction by a member (holder 18) holding relay body 13 (for example, spring 16 and cable 17 of the relay body) or pilot lamp 15 in transparent housing 14. Accordingly, even if pilot lamp 15 is lit, the light emitted from pilot lamp 15 is hardly seen depending on the direction in which relay 11 is viewed, and sometimes the operating state of relay 11 cannot be checked. As illustrated in FIG. 1A, because the light emitted from pilot lamp 15 hardly passes through a corner portion of transparent housing 14, the light emitted from pilot lamp 15 can be hardly seen from this direction (oblique direction).

In the case that a plurality of relays 11 in FIGS. 1A and 1B are arrayed as illustrated in FIG. 2, for example, a light emission point (pilot lamp 15) of a right side relay 11 may be interrupted by transparent housing 14 of a relay 11 located on the left side of FIG. 2. Therefore, the light emitted from pilot lamp 15 is hardly recognizable from all directions.

Despite that pilot lamp 15 is a point light emission in relay 11 of FIG. 1, which makes the relay appear bright, the relay 11 will still be difficult to identify from another relay in the case when a plurality of relays is arrayed adjacent to each other. In particular, when the light emitted from pilot lamps 15 of one of the relays 11 is seen when it is transmitted through transparent housing 14 of the other relay 11, it will be hard to distinguish which relay is brightened. Additionally, because pilot lamp 15 is the point light emission, when disturbance light is reflected by the top surface of the relay, the light emitted from pilot lamp 15 is hardly seen when the disturbance light overlaps the light emitted from pilot lamp 15.

FIG. 3 is a perspective view of a relay 21 disclosed in Japanese Unexamined Patent Publication No. 2006-172731. In relay 21, a portion in which the relay body (not illustrated) is provided above base 22 is covered with cover 23. Rod-shaped light guide 24 extending in a vertical direction is provided in a side surface of cover 23, and the pilot lamp (not illustrated) is arranged inside cover 23 and opposite to an inclined surface on a bottom surface of light guide 24. The inclined surface on the bottom surface of light guide 24 constitutes reflecting surface 25. When the light emitted from the pilot lamp is incident to light guide 24 from a substantially horizontal direction, the light is reflected by reflecting surface 25 to bend an optical path upward, the light travels upward in light guide 24 is then output to outside the cover 23 from the top surface of light guide 24, known as a display surface 26. As a result, display surface 26 located in the top surface of relay 21 looks bright, and the operating state of relay 21 can be visually recognized.

In relay 21, because the top surface of relay 21 is brightened by guiding the light emitted from the pilot lamp using light guide 24 projected from the side surface, a point on an end of the top surface of relay 21 will appear bright. However, visibility is degraded when viewed from a side of a side surface opposite to the side surface through which light guide 24 allows light to pass, thus good visibility cannot be obtained when viewed from all directions.

In the case that a plurality of relays 21 are arrayed, when the top surface of a relay 21 is brightened, the light emission point is more visible behind an adjacent relay 21 compared with the relay 11 in FIG. 1. However, sometimes which relay is brightened is hard to recognize as it depends on the arrangement of the relays. For example, in the case that the relays are arrayed such that the side surfaces of the relays are opposite to each other, the light guide will be located between the relays adjacent to each other. Therefore, display surface 26 will look bright between the relays adjacent to each other, and which relay is brightened will be hard to distinguish from the other relays.

Because only a point of the end of the top surface of relay 21 appears bright, the light emission of relay 21 will be hard to see due to interruption of disturbance light caused by light reflection near the light emission point.

SUMMARY

In accordance with one aspect of an embodiment of the present invention, there is provided a relay in which a relay body and a light source are incorporated in a case, the light source emitting light in conjunction with operation of the relay body, wherein a light guide is provided inside an outer surface of the case, the light guide is configured to take in the light emitted from the light source, to guide the light to a portion parallel to a top panel of the case, and to spread the light in the portion parallel to the top panel, and an optical pattern is provided in at least one of a top surface and a bottom surface of the portion parallel to the top panel, the optical pattern is configured to output, the light guided in the light guide to the portion parallel to the top panel, to outside the case from a top surface of the top panel.

In accordance with another aspect of an embodiment of the present invention, there is provided a relay in which a relay body and a light source are incorporated in a case, the light source emitting light in conjunction with operation of the relay body, wherein an optical pattern is arranged below a top surface of a top panel of the case, the optical pattern is configured to refract the light incident from a bottom surface side and to output the light to outside the case from the top surface of the top panel, and the light source is arranged below the optical pattern such that an optical axis of the light source is oriented toward a horizontal direction or a direction looking up to the top panel from the horizontal direction within a spread angle of the light source.

DETAILED DESCRIPTION

Hereinafter, an exemplary embodiment of the present invention will be described with reference to the accompanying drawings. However, the present invention is not limited to the following embodiments, but various design changes can be made without departing from the scope of the present invention.

First Embodiment

Figure 1A:
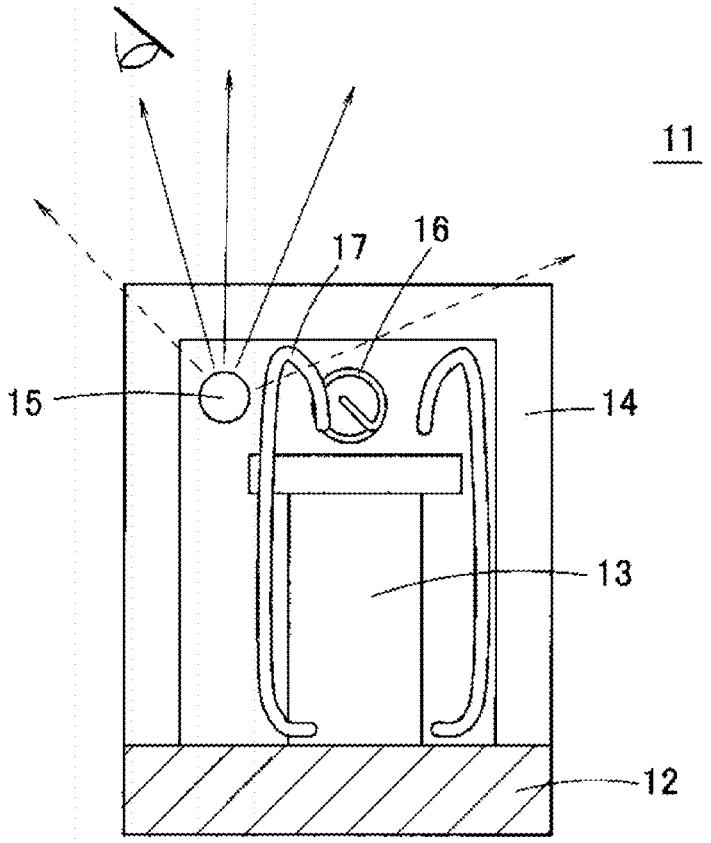
FIG. 1A (Prior Art)
FIGS. 1A and 1B are schematic sectional view and a schematic plan view of a conventional relay incorporating a pilot lamp therein.
Figure 1B:
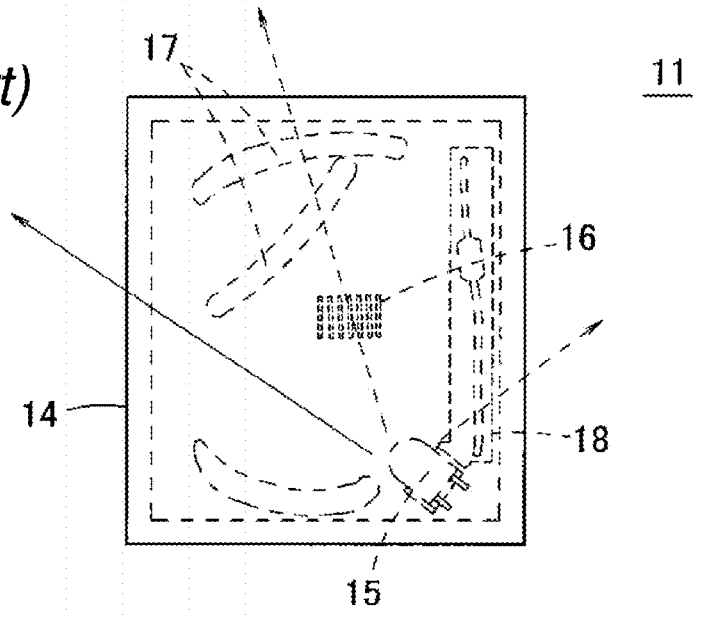
FIG. 1B (Prior Art)
Figure 2:
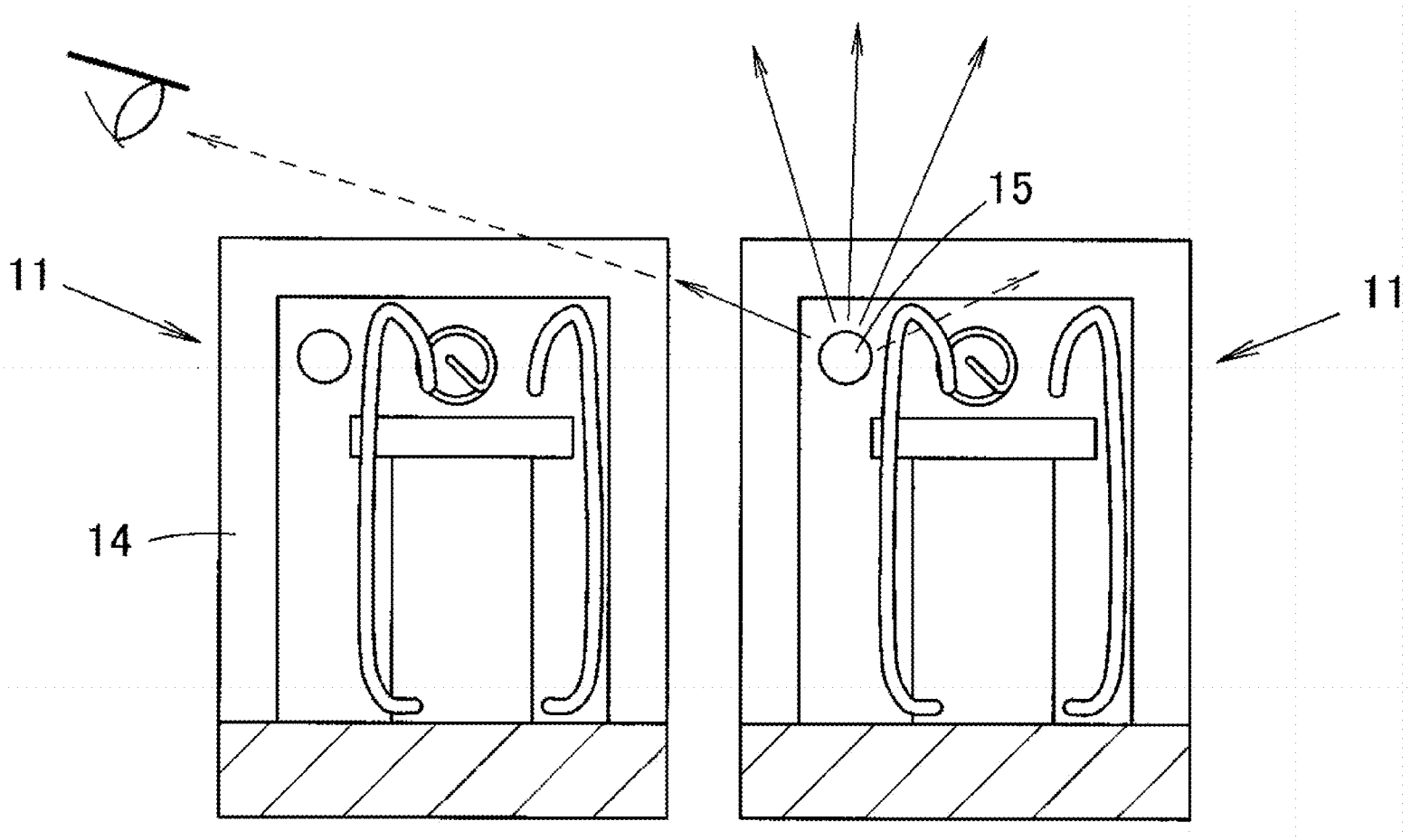
FIG. 2 (Prior Art)
FIG. 2 is a schematic view illustrating a state in which light from one of a plurality of relays is interrupted by another relay when two of the relay in FIG. 1 are arrayed.
Figure 3:
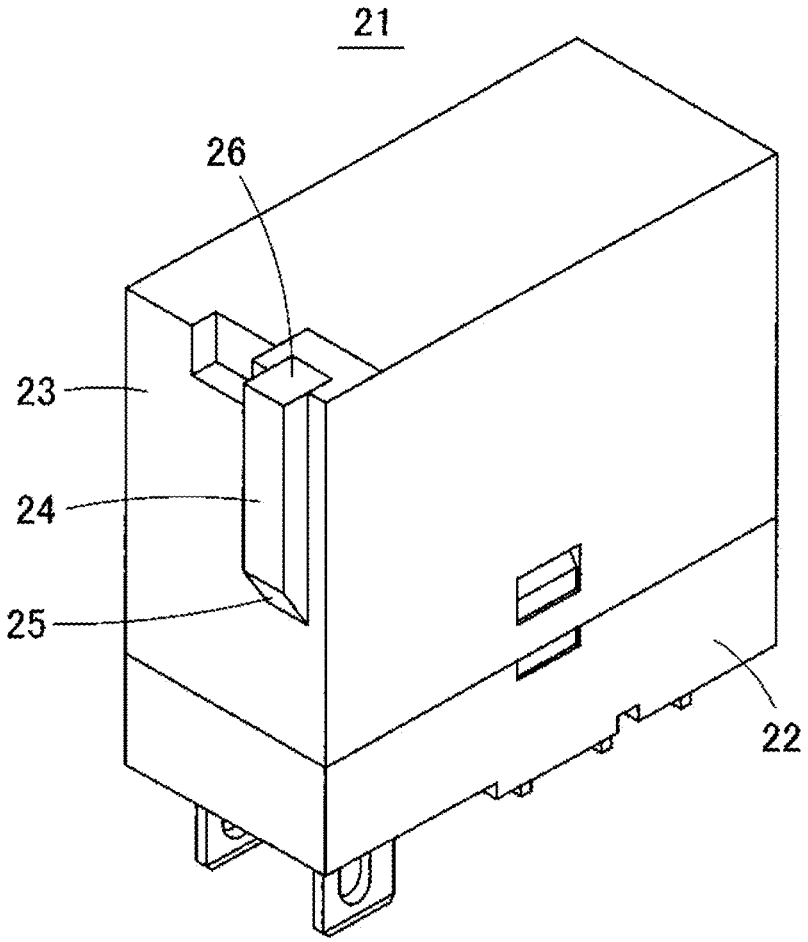
FIG. 3 (Prior Art)
FIG. 3 is a perspective view of a relay disclosed in Japanese Unexamined Patent Publication No. 2006-172731.
Figure 4:
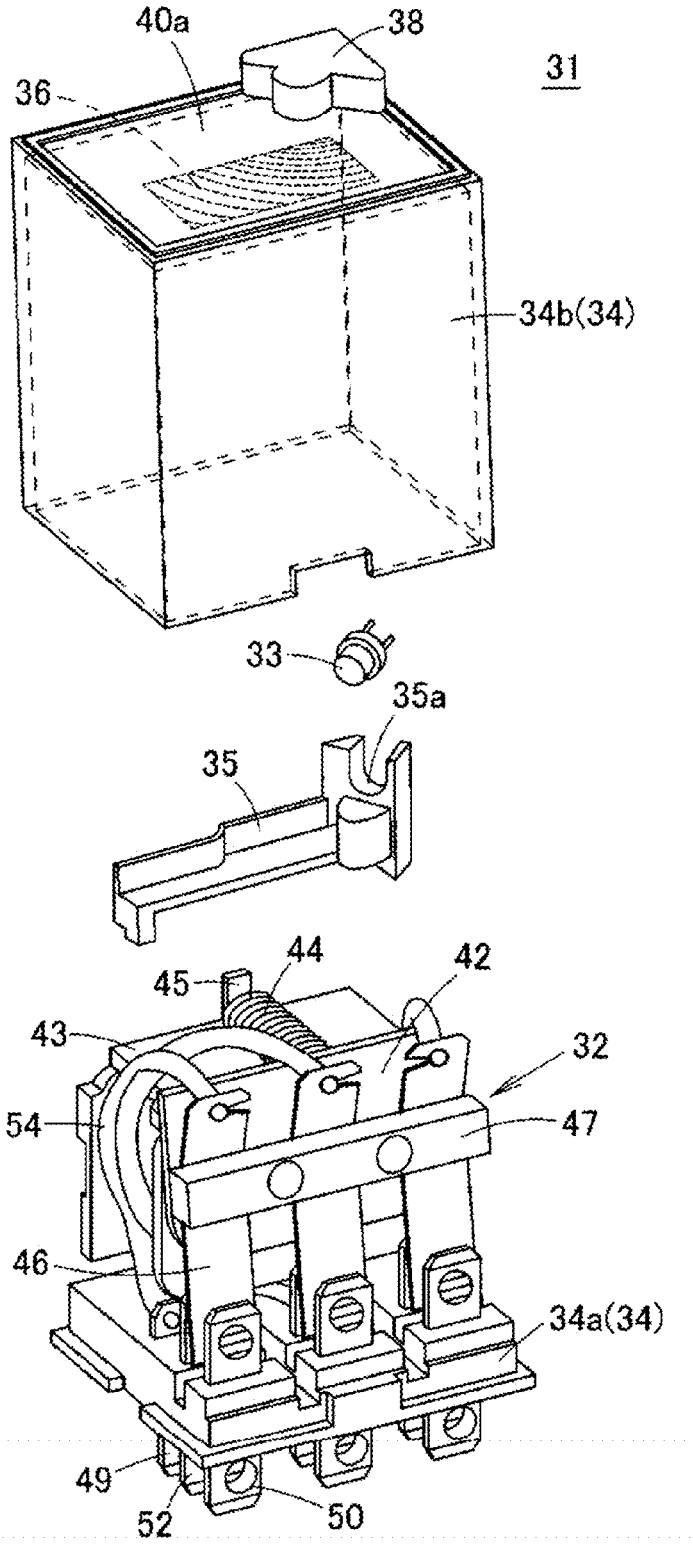
FIG. 4 is a partially exploded perspective view illustrating a relay according to a first embodiment of the present invention.
Figure 5:
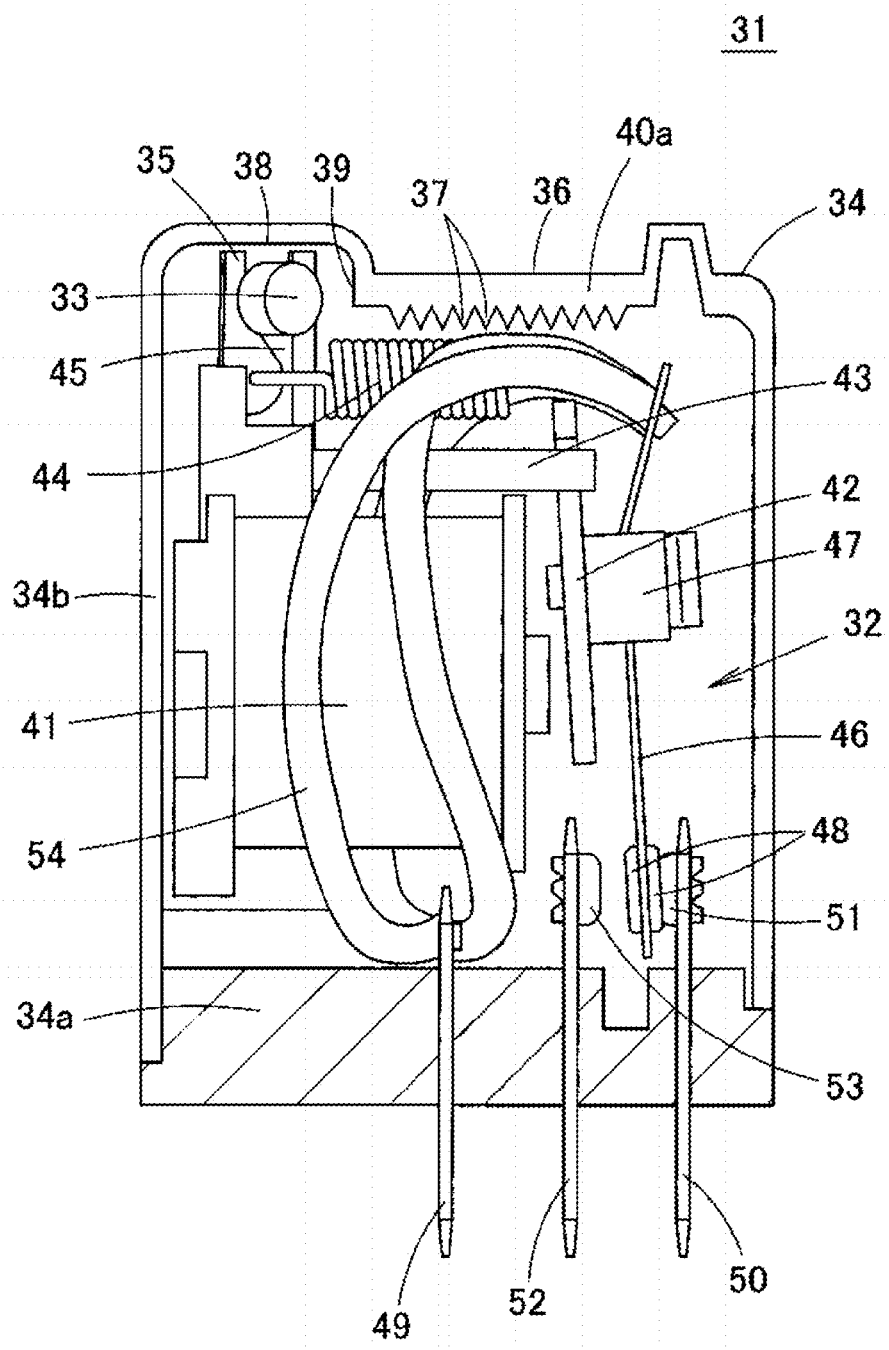
FIG. 5 is a sectional view of the relay in FIG. 4.
Figure 6A:
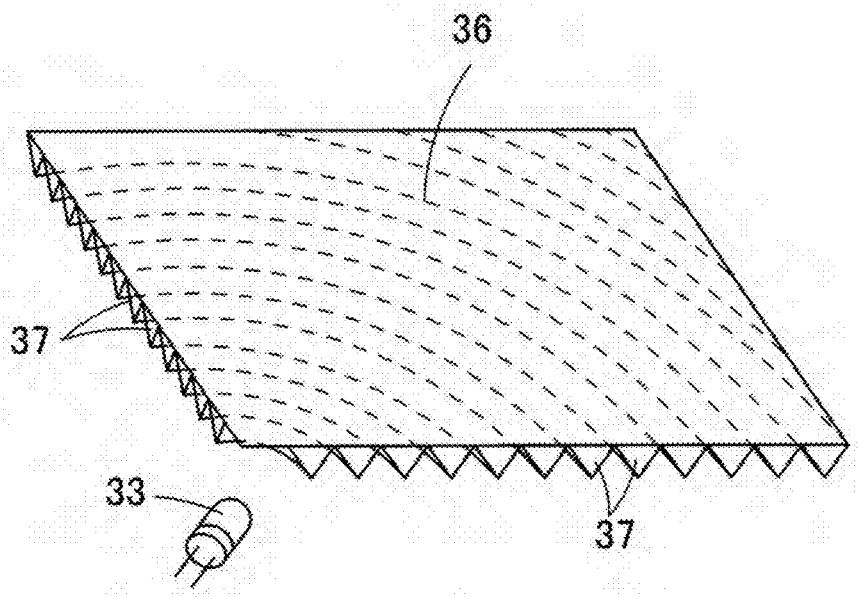
FIG. 6A is a perspective view illustrating an optical pattern provided on an inner surface of a housing of the relay.
Figure 6B:
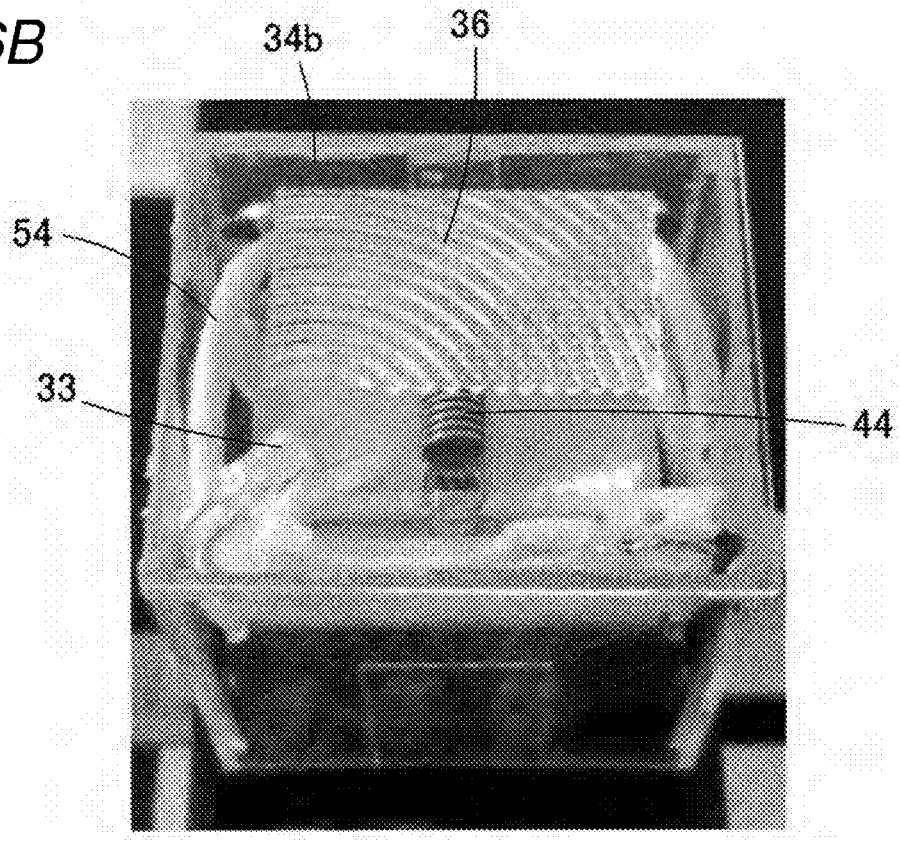
FIG. 6B is a view of a top surface of the housing of the relay viewed from an oblique direction.
Figure 7:
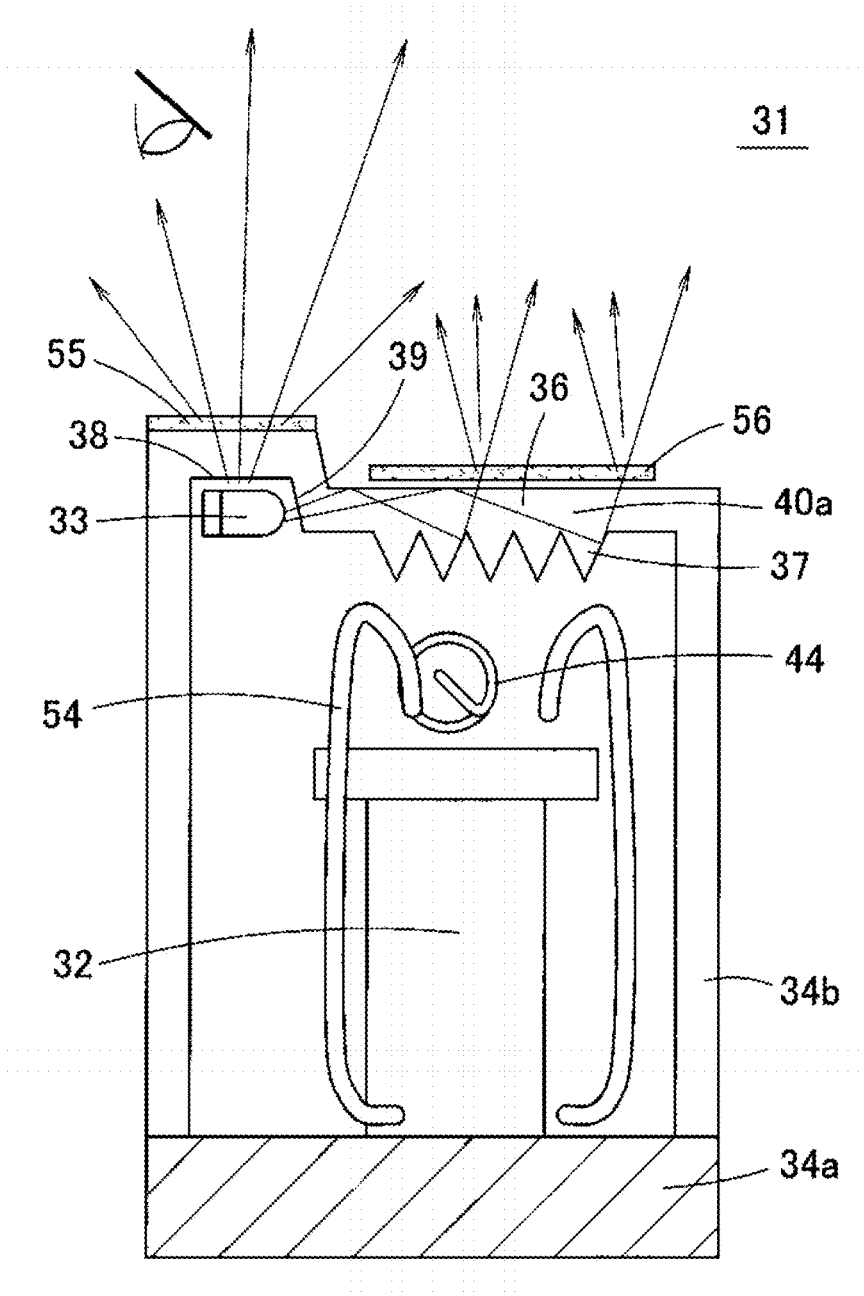
FIG. 7 is a schematic sectional view illustrating action of the relay in FIG. 4.
Figure 8:
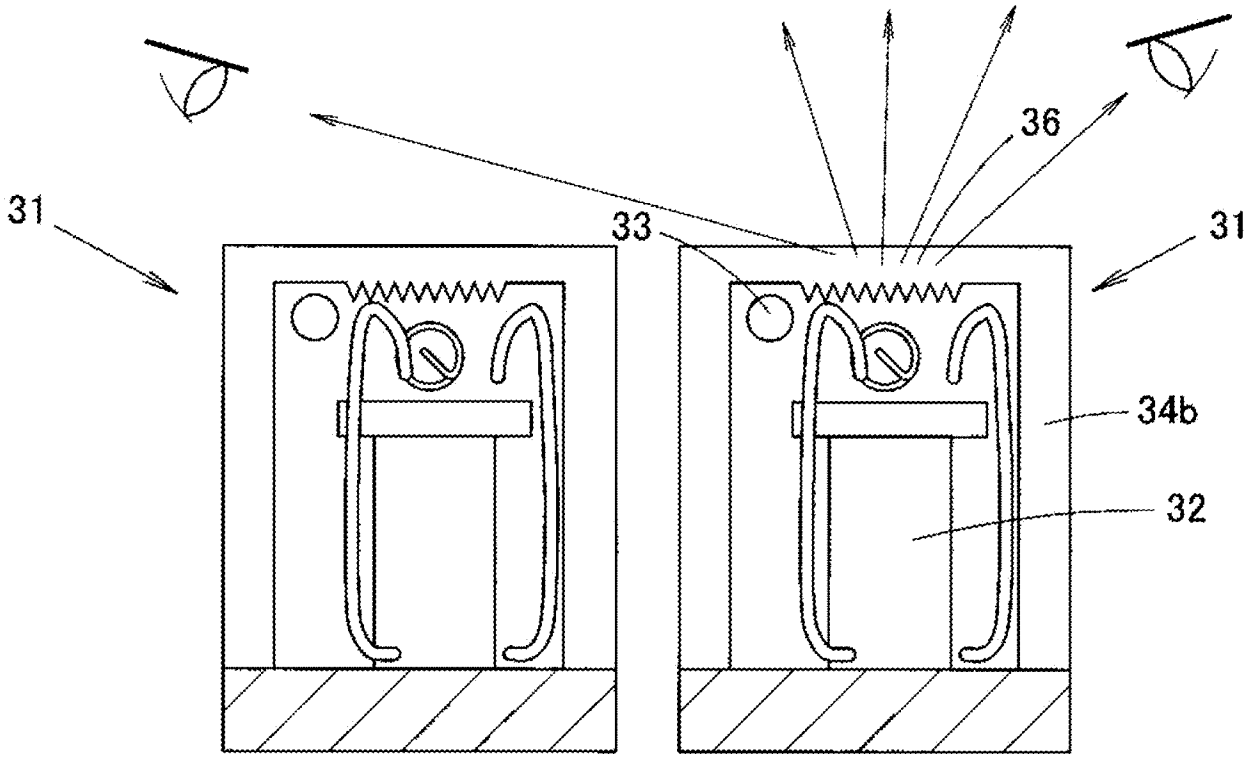
FIG. 8 is a schematic sectional view illustrating a state in which two relays of the first embodiment are arrayed.

A relay according to a first embodiment of the present invention will be described below with reference to FIGS. 4 to 8. FIG. 4 is a partially exploded perspective view illustrating relay 31 of the first embodiment. FIG. 5 is a sectional view of relay 31. FIG. 6A is a perspective view illustrating an optical pattern provided on an inner surface of housing 34*b* of relay 31, and FIG. 6B is a view (photograph) of a top surface of housing 34*b* of relay 31 viewed from an oblique direction. FIGS. 7 and 8 illustrate relay 31 in action.

Relay 31 incorporates relay body 32 and pilot lamp 33 in a case 34. Case 34 includes base 34*a* made of an opaque resin and housing 34*b* made of a transparent resin.

Relay body 32 having a structure in FIGS. 4 and 5 is provided on the top surface of base 34*a*. Coil unit 41 is fixed to the top surface of base 34*a*. A lower portion of armature 42 is opposite to an end surface of an iron core of coil unit 41, and an upper portion of armature 42 is swingably supported by yoke 43. One end of spring 44 (tension spring) is hooked in spring hook 45 provided on the top surface of yoke 43, and the other end of spring 44 is hooked at an upper end of armature 42. Accordingly, armature 42 is swingable back and forth, and the lower portion of armature 42 is inclined to move backwards when coil unit 41 is excited. Because a portion higher than a supporting point of armature 42 is elastically pulled backwards by spring 44, the lower portion of armature 42 separates from the iron core to move forward when coil unit 41 is demagnetized.

A plurality of movable contact springs 46 are attached to a front surface of armature 42 by support 47 and are arranged in parallel to one another. A plurality of common terminals 49, a plurality of normally-closed terminals 50, and a plurality of normally-opened terminals 52 are inserted in base 34*a* so as to slot vertically into base 34*a*. An upper end of the movable contact spring 46 is electrically connected to each common terminal 49 by cable 54. A lower end portion of movable contact spring 46 is located between upper end portions of normally-closed terminal 50 and normally-opened terminal 52, and movable contacts 48 are provided on both surfaces of the lower end portion of movable contact spring 46, respectively. In front of movable contact 48, normally-closed contact 51 is provided in the upper end portion of each normally-closed terminal 50 so as to be opposite to movable contact 48. At the back of movable contact 48, normally-opened contact 53 is provided in the upper end portion of each normally-opened terminal 52 so as to be opposite to movable contact 48.

When coil unit 41 is not excited in relay body 32, because the lower portion of armature 42 is moved forward after separating from the iron core, the lower portion of movable contact spring 46 also moves forward. Therefore, movable contact 48 is in contact with normally-closed contact 51 to close a circuit between common terminal 49 and normally-closed terminal 50, and movable contact 48 separates from normally-opened contact 53 to open a circuit between common terminal 49 and normally-opened terminal 52.

When coil unit 41 is excited, the lower portion of armature 42 is attracted by the iron core to move backwards, and the lower portion of movable contact spring 46 also moves backwards. Therefore, movable contact 48 comes into contact with normally-opened contact 53 to close the circuit between common terminal 49 and normally-opened terminal 52, and movable contact 48 separates from normally-closed contact 51 to open the circuit between common terminal 49 and normally-closed terminal 50.

Pilot lamp 33 is held by holder 35 and fitted in recess 35*a* provided in an end portion of holder 35. Holder 35 is fixed to the upper surface of yoke 43. Therefore, pilot lamp 33 is located in the upper end portion of a space in case 34. Pilot lamp 33 is connected to a wiring portion (not illustrated). Pilot lamp 33 is lit or turned off according to an operating state of relay 31, which enables a worker to visually recognize the operating state of relay 31. For example, pilot lamp 33 is turned off during a non-operating state of relay 31, namely, when the circuit between common terminal 49 and normally-opened terminal 52 is opened and the circuit between common terminal 49 and normally-closed terminal 50 is closed. On the other hand, pilot lamp 33 is lit during the operating state of relay 31, namely, when the circuit between common terminal 49 and normally-opened terminal 52 is closed and the circuit between common terminal 49 and normally-closed terminal 50 is opened.

Housing 34*b* is a molded article made of a transparent resin, such as a polycarbonate resin, which has a high refractive index. Alternatively, housing 34*b* may be a molded article made of a translucent resin or a colored transparent resin. In such cases, desirably the translucent resin having high transparency and the colored transparent resin having a light color are used such that inside of relay 31 can be checked.

Light source arrangement part 38 in which a bottom surface is recessed upwards is provided in a corner portion of top panel 40*a* of housing 34*b*. Pilot lamp 33 resides within light source arrangement part 38 when base 34*a* is attached to housing 34*b* to accommodate relay body 32 and pilot lamp 33 in case 34. Pilot lamp 33 is accommodated in the recess of light source arrangement part 38 such that an optical axis of pilot lamp 33 is substantially oriented towards a horizontal direction. When pilot lamp 33 is viewed from a direction perpendicular to top panel 40*a*, pilot lamp 33 is installed such that the optical axis of pilot lamp 33 is oriented towards optical pattern region 36 (in the example of the drawings, the optical axis of pilot lamp 33 is substantially oriented towards a diagonal direction of top panel 40*a*). In sidewall surfaces of light source arrangement part 38, a wall surface located in a light emitting direction (optical axis direction) of pilot lamp 33 constitutes light incident surface 39 through which light is incident to inside of top panel 40*a*.

As illustrated in FIGS. 6A and 6B, in front of pilot lamp 33, optical pattern region 36 is formed in a part of the bottom surface of top panel 40*a*. In optical pattern region 36, as illustrated in FIG. 6A, many prism-shaped optical patterns 37 are formed into arc shapes around a place (a corner of optical pattern region 36) where the light is incident to optical pattern region 36 (or around the position of pilot lamp 33, hereinafter the same holds true). In the example of FIG. 6A, prism-shaped optical pattern 37 having a triangular shape in cross-section extends into a substantially arc shape around the light incident place, and optical patterns 37 are concentrically arranged. Alternatively, pyramid-like optical patterns 37 may concentrically be arranged around pilot lamp 33.

Figure 9:
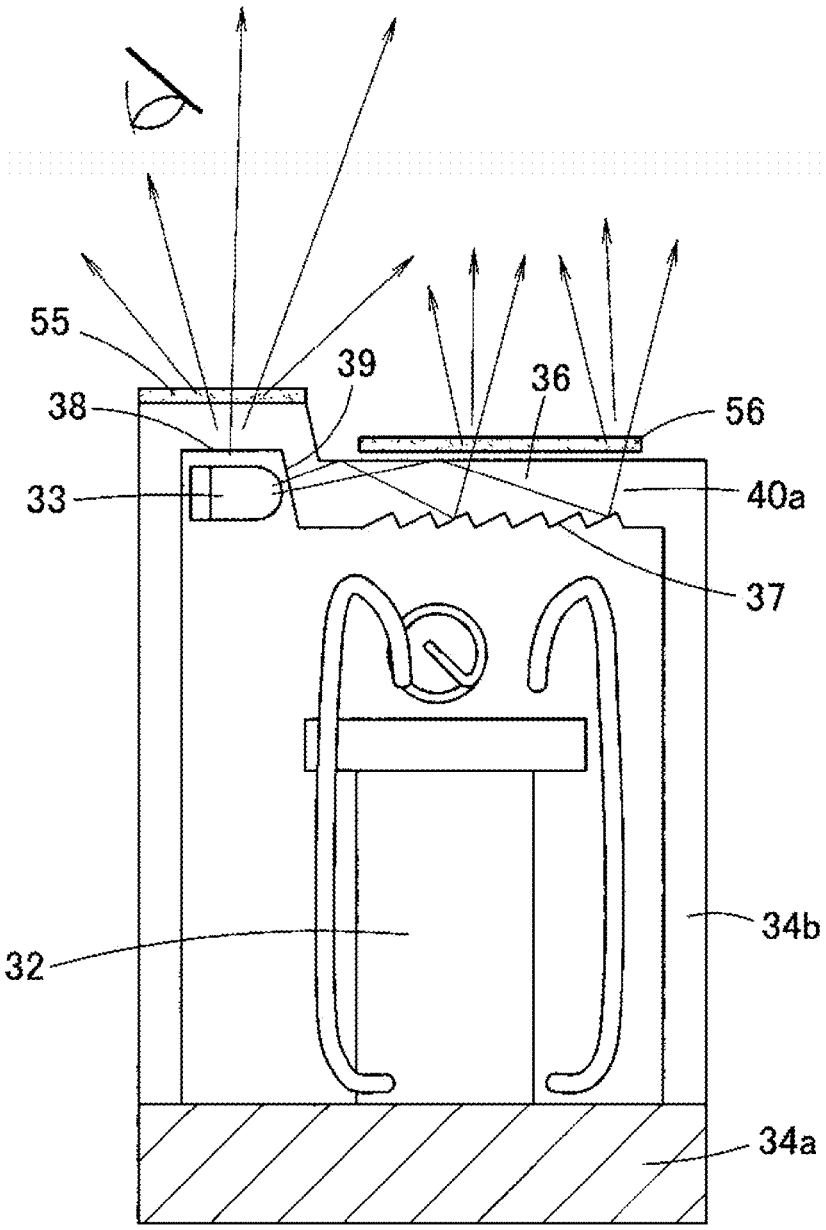
FIG. 9 is a schematic sectional view illustrating a relay according to a first modification of the first embodiment.

As illustrated in FIG. 5, optical pattern 37 may be projected from the bottom surface of top panel 40*a*, or optical pattern 37 having a triangular prism shape may be recessed in the bottom surface of top panel 40*a* like a first modification in FIG. 9.

Optical pattern region 36 can be formed on the top surface of top panel 40*a*. However, when optical pattern region 36 is provided on the top surface of top panel 40*a*, dust and dirt may accumulate in optical pattern region 36 and be hard to remove. Therefore, preferably optical pattern region 36 is provided in a bottom surface of top panel 40*a*.

In relay 31, sometimes the state of relay body 32 is checked through top panel 40*a* of housing 34*b*. For this purpose, optical pattern region 36 is not provided on the whole surface of top panel 40*a* but is preferably formed in a manner to leave a region (transparent operation check window) for checking the inside of optical pattern region 36. On the other hand, in order to perform planar emission at the top panel 40*a* to enable recognition of light from all directions, preferably optical pattern region 36 is made with an area of at least ⅕ times as large as that of top panel 40*a*.

As illustrated in FIG. 7, when pilot lamp 33 of relay 31 is lit, the light emitted from pilot lamp 33 is incident to top panel 40*a* from light incident surface 39, and the light is guided while reflected (total reflection) by the top and bottom surfaces of the top panel 40*a*, which is part of the light guide, and spread in a planar state in top panel 40*a*. With regard to the light guided in top panel 40*a* to reach optical pattern region 36, the light that is reflected by optical pattern 37 and oriented upwards is output to outside the housing 34*b* (case) from the top surface of top panel 40*a*. Accordingly, the light is output from the entire optical pattern region 36, and the optical pattern region 36 of the top panel 40*a* emits the light in the planar state.

In relay 31, the light emitted from pilot lamp 33 is guided in top panel 40*a*, and the top surface of top panel 40*a* emits the light in the planar state in optical pattern region 36. Therefore, the light is not interrupted by structures (such as cable 54, spring 44, and holder 35) in relay 31 or the corner portion of housing 34*b*, thereby allowing the light of pilot lamp 33 to be recognized from all directions. Additionally, the top surface of relay 31 emits widely the light in the planar state, so that the lighting state of relay 31 can be visually recognized without the interruption of disturbance light even if the disturbance light is reflected by the top surface of relay 31.

As illustrated in FIG. 8, even if a plurality of relays 31 are arrayed, the top surface of relay 31 emits the light in the planar state. Therefore, the light is not interrupted by adjacent relay 31, but the light of relay 31 can be recognized from all directions. Additionally, when the top surface of relay 31 emits the light in the planar state, a wide area will be brightened. Therefore, which relay 31 is brightened is easily distinguished even if the plurality of relays 31 are arrayed adjacent to each other.

In relay 31, even if pilot lamp 33 is horizontally installed and pilot lamp 33 has a certain extent of wide directional characteristic, the light is still emitted upwards from pilot lamp 33 through light source arrangement part 38. As illustrated in FIG. 7, in order to efficiently use the light, when diffusion optical system 55 adheres to the top surface of top panel 40*a* above light source arrangement part 38, or when diffusion optical system 55 is processed in the top surface of top panel 40*a* to diffuse the light transmitted through light source arrangement part 38, a light emission area can be widened and visibility can be enhanced. Examples of diffusion optical systems 55 include a spherical projection having a relatively small curvature and a transparent sheet in which many projections having thin convex lens shapes are provided.

As illustrated in FIG. 7, in optical pattern region 36, diffusion optical system 56 may be provided on the top surface of top panel 40*a*. Diffusion optical system 56 may be processed on the top surface of top panel 40*a*, overlapping and in close contact with the top surface of top panel 40*a*, or provided on the top surface of top panel 40*a* with an air layer interposed therebetween. When diffusion optical system 56 is provided in optical pattern region 36, the directional characteristic of the light output from optical pattern region 36 is widened to further enhance the visibility from all directions.

Modifications of First Embodiment

In the first modification of the first embodiment, as described above, optical pattern 37 may be recessed in the bottom surface of top panel 40*a*. Various modifications can be made in addition to the first modification.

Figure 10:
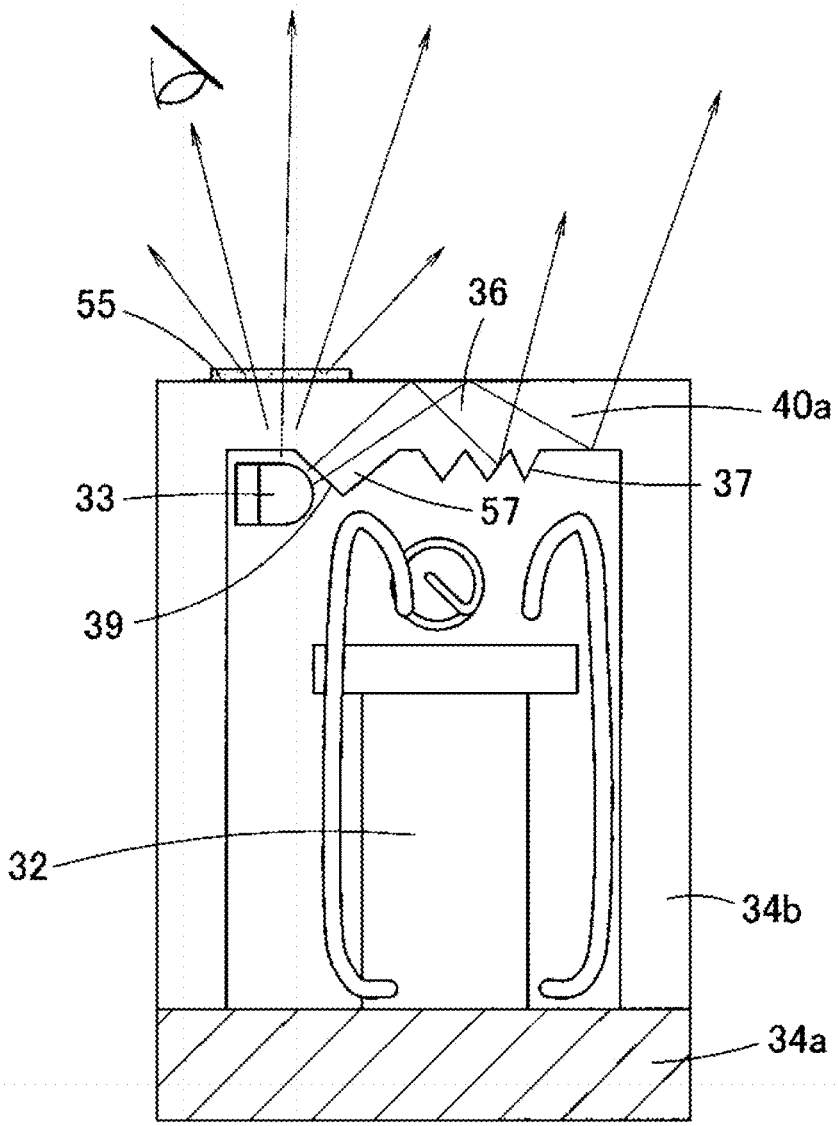
FIG. 10 is a schematic sectional view illustrating a relay according to a second modification of the first embodiment.

FIG. 10 is a schematic sectional view illustrating a relay according to a second modification of the first embodiment. In the second modification of the first embodiment, instead of providing light source arrangement part 38, a protrusion having a light incident surface, namely, light introducing prism 57 is provided at a position opposite to pilot lamp 33. The light emitted obliquely upwards from pilot lamp 33 is taken in top panel 40*a* from an inclined surface (light incident surface 39) of light introducing prism 57, spreads in the planar state in top panel 40*a*, and is reflected by optical pattern 37, whereby the light is output upwards.

Figure 11:
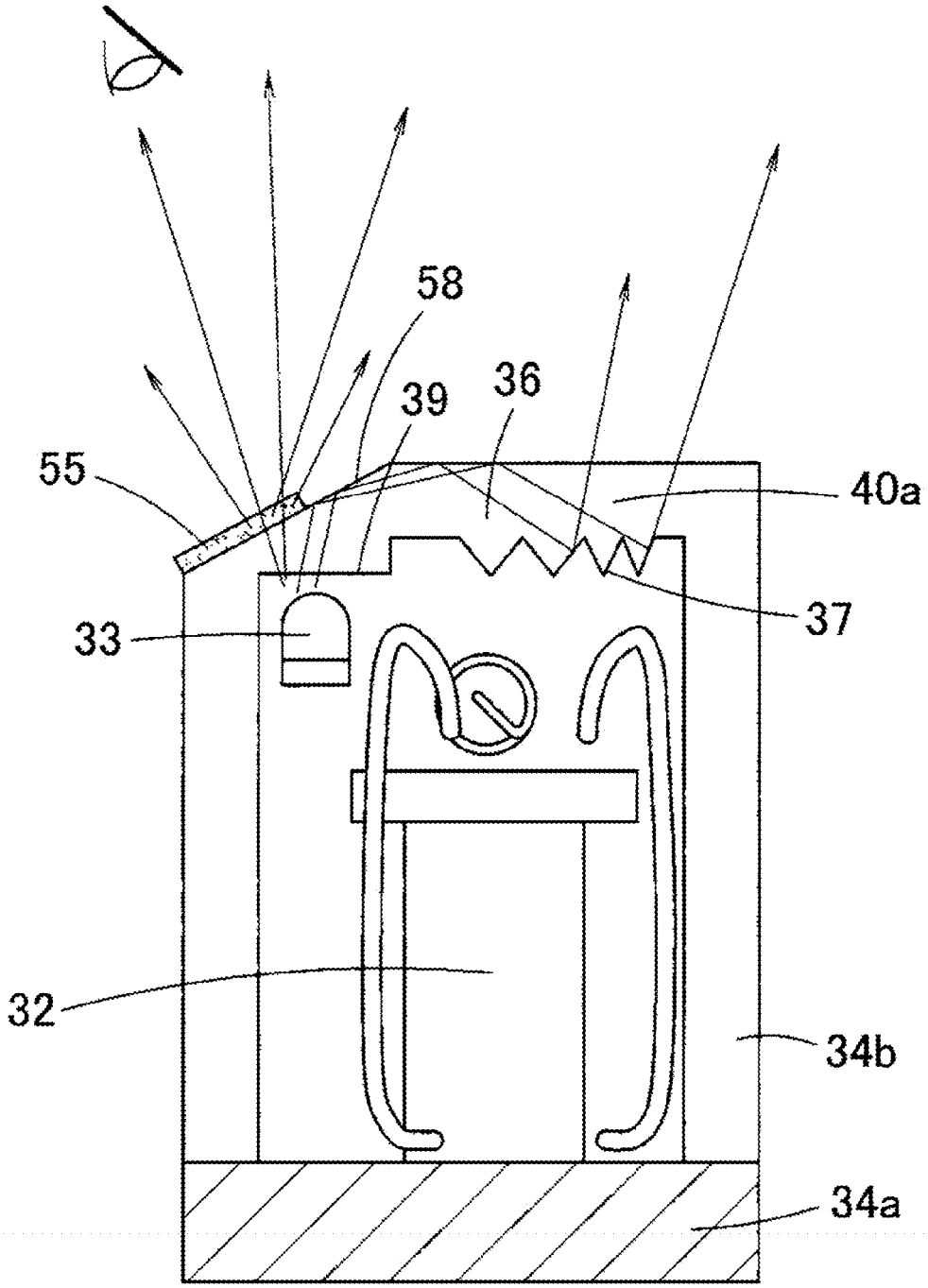
FIG. 11 is a schematic sectional view illustrating a relay according to a third modification of the first embodiment.

FIG. 11 is a schematic sectional view illustrating a relay according to a third modification of the first embodiment. In the third modification of the first embodiment, pilot lamp 33 is arranged such that an optical axis of pilot lamp 33 is oriented upwards. Horizontal light incident surface 39 is provided above pilot lamp 33, and inclined reflecting surface 58 is provided in the top surface of top panel 40*a* and opposite to light incident surface 39. The light emitted upwards from pilot lamp 33 is incident to top panel 40*a* from light incident surface 39, and is totally reflected by reflecting surface 58, whereby an optical path of the light is bent into a direction substantially parallel to top panel 40*a*. The light guided in top panel 40*a* spreads in the planar state in top panel 40*a*, and is reflected by optical pattern 37, whereby the light is output upwards. In reflecting surface 58, preferably diffusion optical system 55 is provided in a region where the light of pilot lamp 33 is not totally reflected but transmitted.

Figure 12:
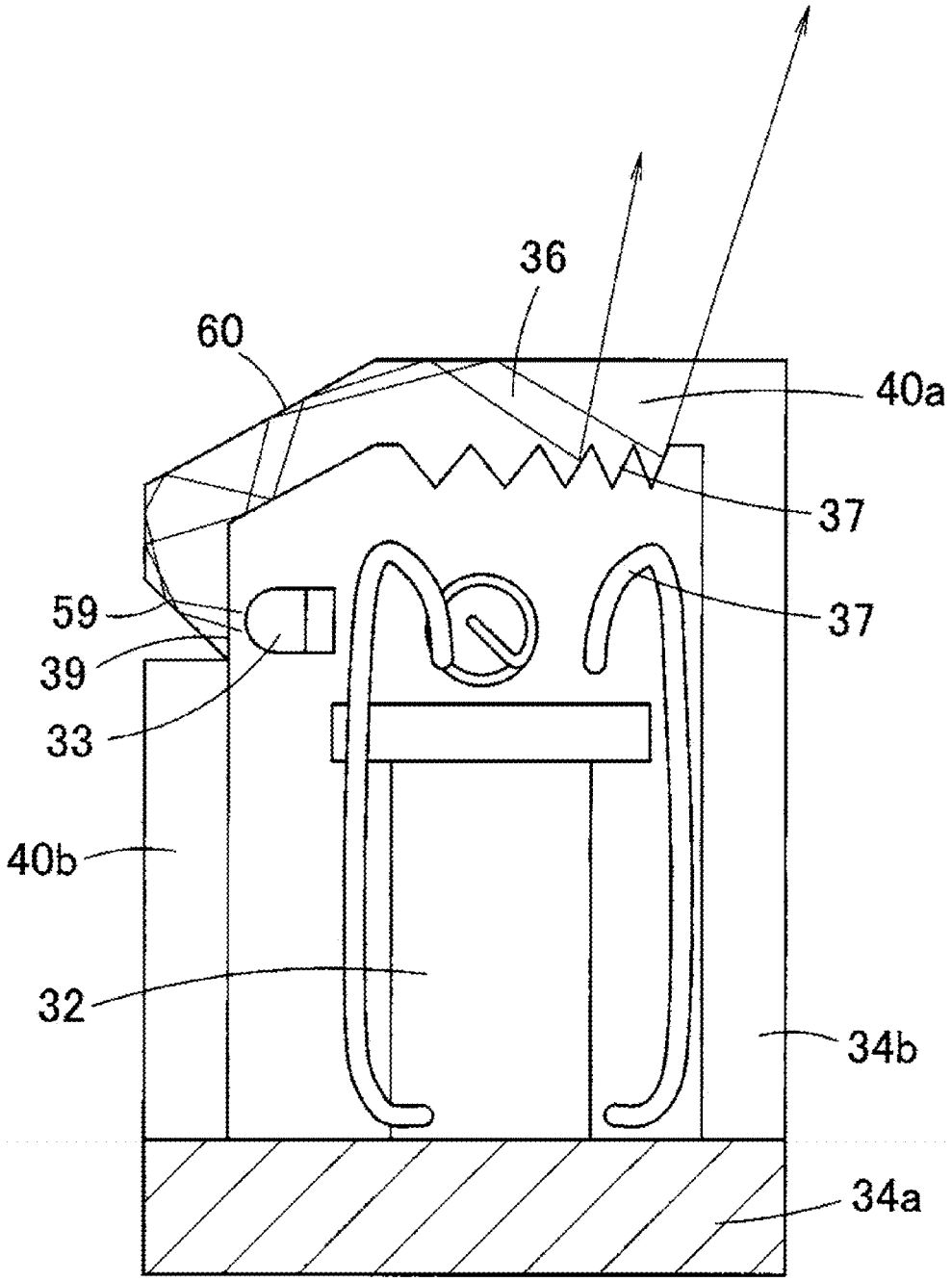
FIG. 12 is a schematic sectional view illustrating a relay according to a fourth modification of the first embodiment.

FIG. 12 is a schematic sectional view illustrating a relay according to a fourth modification of the first embodiment. In the fourth modification of the first embodiment, pilot lamp 33 is arranged such that the optical axis of pilot lamp 33 is oriented towards the horizontal direction and such that pilot lamp 33 is opposite to sidewall plate 40*b* of housing 34*b*. In an inner surface of sidewall plate 40*b*, a place opposite to pilot lamp 33 constitutes light incident surface 39. In an outer surface of sidewall plate 40*b*, reflecting surface 59 (first reflecting surface) inclined with respect to a surface perpendicular to a thickness direction of sidewall plate 40*b* is provided in a place opposite to light incident surface 39. In outer surface of housing 34*b*, inclined reflecting surface 60 (second reflecting surface) is provided in a corner portion located above reflecting surface 59. Reflecting surfaces 59 and 60 may be made of a material totally reflecting the light, or formed by bonding a reflecting tape or by applying a reflecting paint.

In the fourth modification of the first embodiment, top panel 40*a* and sidewall plate 40*b* of housing 34*b* in FIG. 12 constitute the light guide. That is, the light emitted in the horizontal direction from pilot lamp 33 is incident to sidewall plate 40*b* from light incident surface 39, and is reflected by reflecting surface 59, whereby the optical path of the light is bent upwards. The light reflected by reflecting surface 59 is incident to reflecting surface 60 through sidewall plate 40*b*, is reflected by reflecting surface 60, and is guided in the direction parallel to top panel 40*a*. The light guided through the top panel 40*a* spreads in the planar state in top panel 40*a*, and is reflected by optical pattern 37, whereby the light is output upwards.

As illustrated in FIGS. 10 to 12, a sectional shape of optical pattern 37 may gradually be changed with distance from pilot lamp 33. Because a quantity of light reaching optical pattern 37 decreases with distance from pilot lamp 33, desirably optical pattern 37 located farther away from pilot lamp 33 is formed into a shape having higher light output efficiency of the output of the light from top panel 40*a* in order to obtain uniform luminance in optical pattern region 36.

Figure 13:
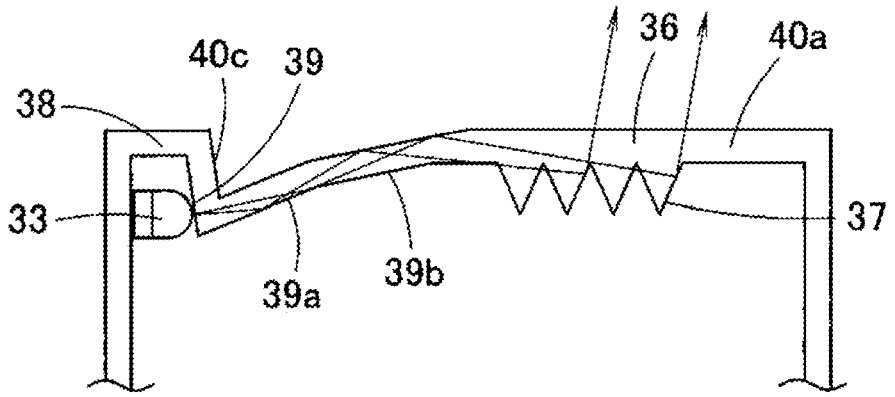
FIG. 13 is a schematic sectional view illustrating a relay according to a fifth modification of the first embodiment.

FIG. 13 is a schematic sectional view illustrating a relay according to a fifth modification of the first embodiment. In the fifth modification of the first embodiment, recess 40*c* having a substantially V-shape in section is provided in the top surface of top panel 40*a*. Recess 40*c* is formed into an arc shape around the position of pilot lamp 33 when viewed from the direction perpendicular to the top surface of top panel 40*a*. The place surrounded by recess 40*c* constitutes light source arrangement part 38, and pilot lamp 33 is accommodated in the recess formed in the bottom surface of light source arrangement part 38. In recess 40*c*, the place opposite to pilot lamp 33 constitutes light incident surface 39, and inclined surfaces 39*a* and 39*b* extend toward optical pattern region 36 from light incident surface 39. In the example of FIG. 13, two inclined surfaces 39*a* and 39*b* have different inclined angles. Alternatively, the inclined angle of the inclined surface may be kept constant, or curved.

In the fifth modification of the first embodiment, recess 40*c* is formed by downwardly recessing a part of top panel 40*a*, thereby forming light incident surface 39. The light of pilot lamp 33 incident to top panel 40*a* from light incident surface 39 is guided through inclined surfaces 39*a* and 39*b* to reach optical pattern region 36, and the light is output upward from optical pattern region 36.

Figure 14:
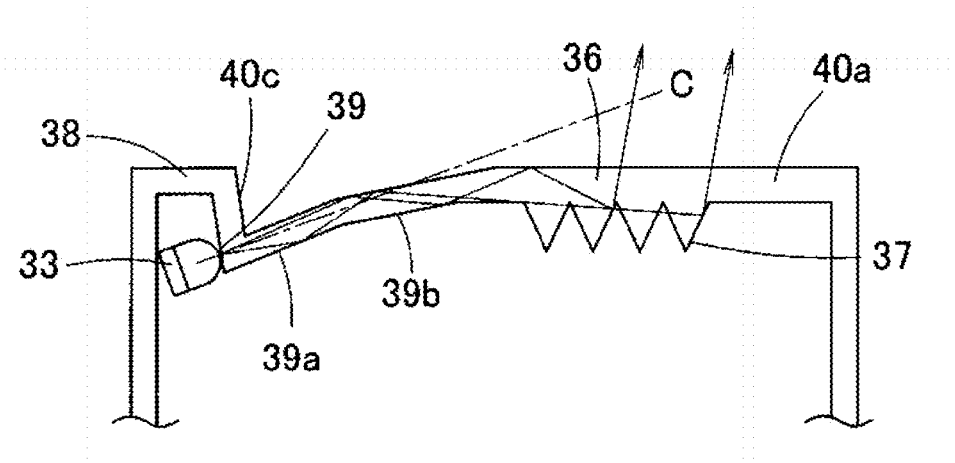
FIG. 14 is a schematic sectional view illustrating a relay according to a sixth modification of the first embodiment.

In the fifth modification of the first embodiment, as illustrated in FIG. 14, the optical axis of pilot lamp 33 may be inclined towards the direction close to an inclination of the inclined surface. Preferably the optical axis of pilot lamp 33 is inclined in a range greater than 0° and less than or equal to 30°.

Second Embodiment

Figure 15:
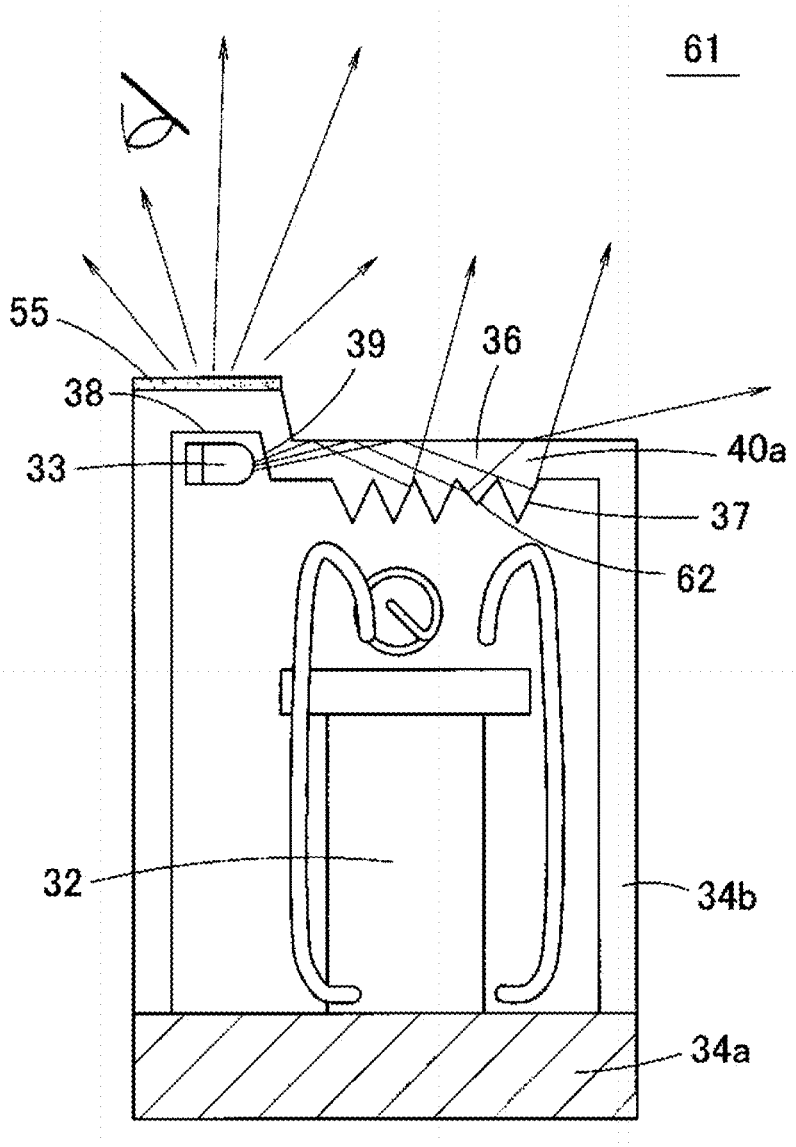
FIG. 15 is a schematic sectional view illustrating a relay according to a second embodiment of the present invention.

FIG. 15 is a schematic sectional view illustrating relay 61 according to a second embodiment of the present invention.

In relay 61, a plurality of types of optical patterns is provided in optical pattern region 36. Two types of optical patterns 37 and 62 are provided in the example of FIG. 16. Optical pattern 37 of the second embodiment is identical to that of the first embodiment, and the light guided through top panel 40*a* is reflected upwards. Optical pattern 62 reflects the light guided through top panel 40*a* towards an obliquely horizontal direction, namely, a direction having a small angle with respect to a horizontal surface. For example, optical pattern 37 and optical pattern 62 are formed into triangular prisms or pyramid-like prisms. Optical pattern 37 and optical pattern 62 differ from each other in the inclined angle of the inclined surface. Because other configurations of the second embodiment are similar to those of the first embodiment, the identical component is designated by the identical numeral, and the description is omitted (the same holds true from a third embodiment).

Figure 16B:
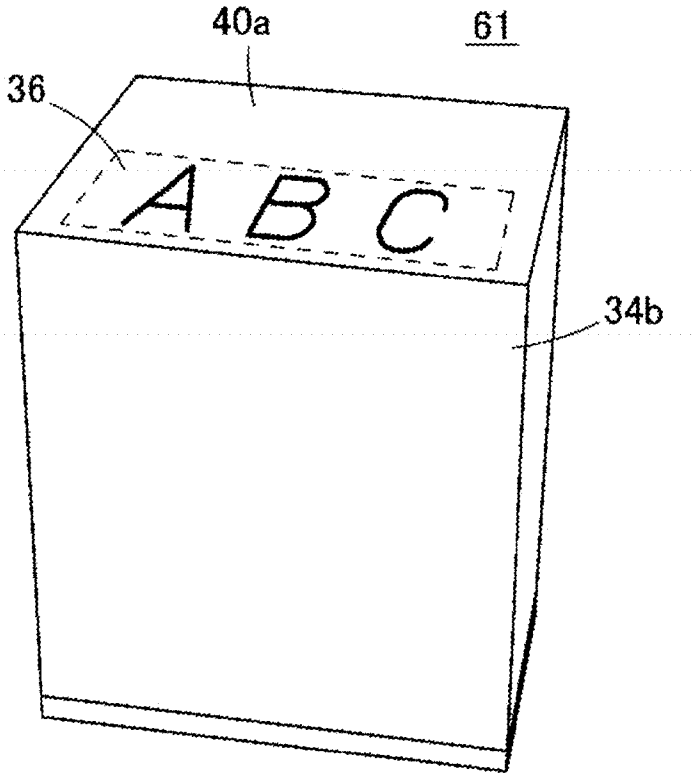
FIG. 16B is a schematic view illustrating a state in which the relay of the second embodiment is viewed obliquely from above.
Figure 16A:
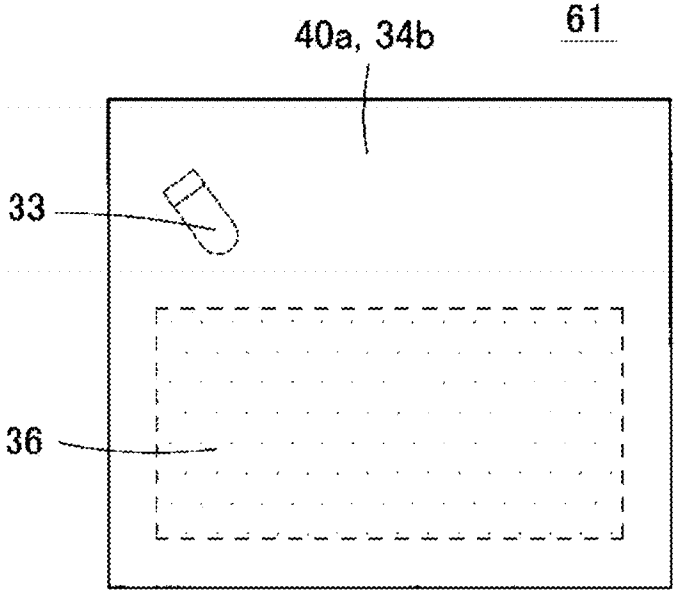
FIG. 16A is a schematic view illustrating a state in which the relay of the second embodiment is viewed from directly above.

When relay 61 is viewed from above while pilot lamp 33 is lit, the light reflected by optical pattern 37 appears brightly. Therefore, when optical patterns 37 are substantially uniformly distributed in the entire optical pattern region 36, the entire optical pattern region 36 will appear bright as illustrated in FIG. 16A. On the other hand, the light reflected by optical pattern 62 is seen when relay 61 is viewed from an oblique direction. For example, when optical patterns 62 are arranged in the order of "ABC" in optical pattern region 36, characters of "ABC" viewed from the oblique direction will appear brightly as illustrated in FIG. 16B. Therefore, information, such as the character, a numerical character, and a mark, which is previously formed by optical pattern 62, can be visually recognized during the lighting of pilot lamp 33 only when viewed from the specific direction.

Third Embodiment

Figure 17:
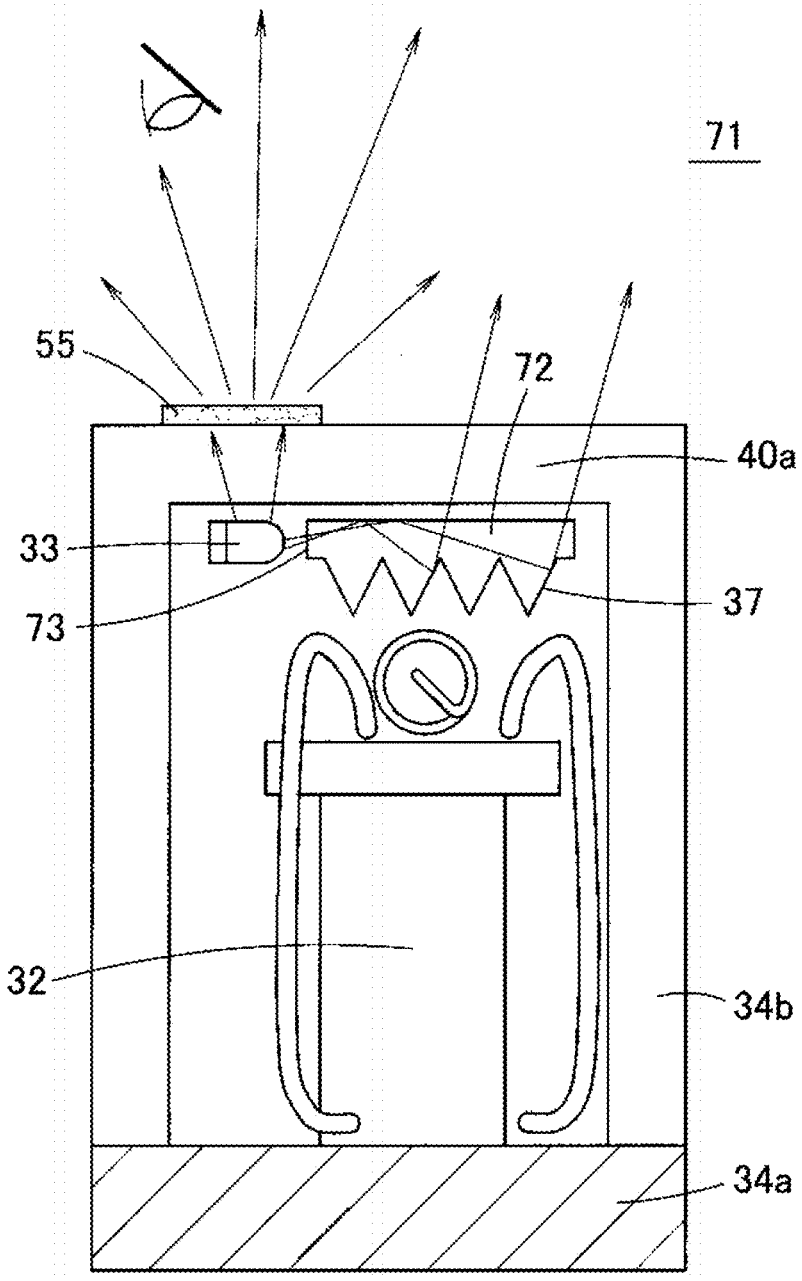
FIG. 17 is a schematic sectional view illustrating a relay according to a third embodiment of the present invention.

FIG. 17 is a schematic sectional view illustrating relay 71 according to a third embodiment of the present invention. In relay 71, light guide plate 72 constituting the light guide is arranged immediately below top panel 40*a* of housing 34*b*. The corner portion of light guide plate 72 is cut to form light incident surface 73. Pilot lamp 33 is arranged at the position opposite to light incident surface 73. In the bottom surface of light guide plate 72, many prism-shaped optical patterns 37 are formed into the arc shape around the place where the light is incident to optical pattern region 36 (see FIG. 6A).

In relay 71, the light emitted from pilot lamp 33 is incident to light guide plate 72 from light incident surface 73, and the light spreads in light guide plate 72 upon being reflected by the top surface and the bottom surface of light guide plate 72. When the light propagating in light guide plate 72 is incident to optical pattern 37, the light incident to optical pattern 37 is reflected towards the direction perpendicular to the top surface of light guide plate 72. The light is emitted from the top surface of light guide plate 72, and is transmitted through top panel 40*a* to light up the region opposite to light guide plate 72 with respect to top panel 40*a*.

In the third embodiment, desirably light guide plate 72 has the area of at least ⅕ times as large as that of top panel 40*a*.

For the use of light guide plate 72, because there is a low risk of leaving the dust and dirt in the top surface of housing 34*b*, optical pattern 37 may be provided in the top surface of light guide plate 72.

Fourth Embodiment

Figure 18:
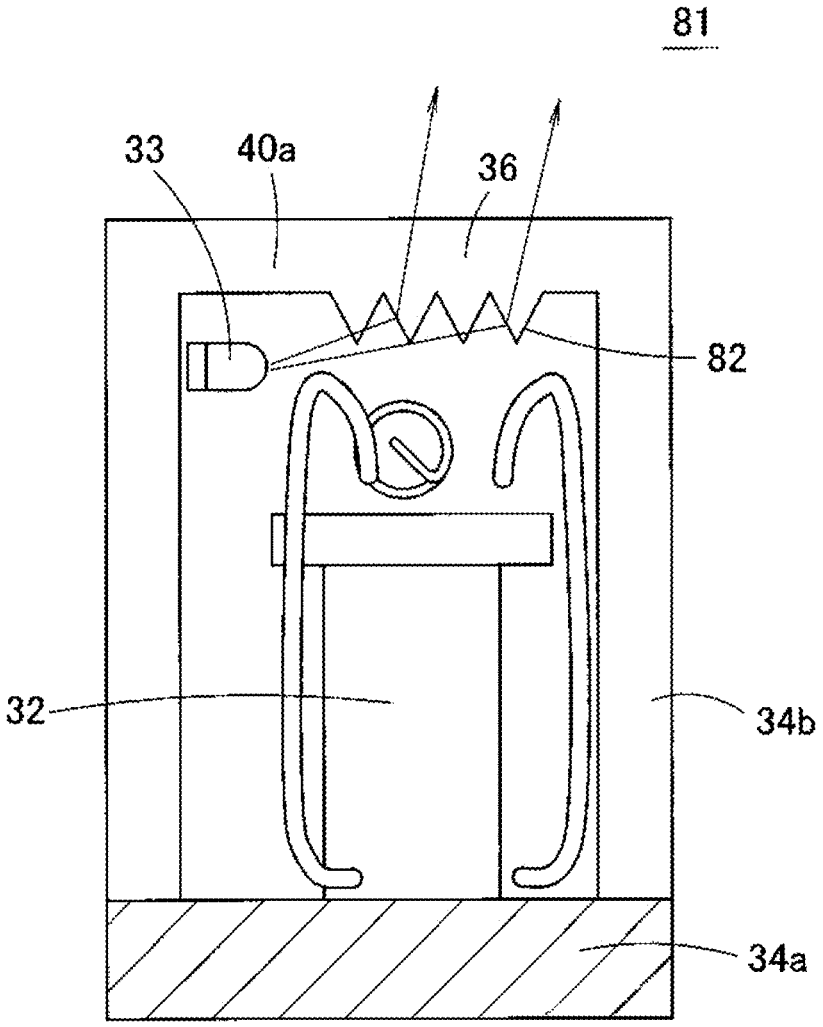
FIG. 18 is a schematic sectional view illustrating a relay according to a fourth embodiment of the present invention.

FIG. 18 is a schematic sectional view illustrating relay 81 according to a fourth embodiment of the present invention. In the fourth embodiment, optical pattern 82 is formed in the bottom surface of optical pattern region 36 defined in a predetermined region of top panel 40*a*. Pilot lamp 33 is arranged on an obliquely lower side of optical pattern region 36 such that the optical axis of pilot lamp 33 is oriented towards the horizontal direction or the direction looking up to top panel 40*a* from the horizontal direction within a spread angle of pilot lamp 33. As used herein, the spread angle of pilot lamp 33 means an angle formed between the optical axis and the direction in which light intensity becomes half of light intensity in the optical axis direction of pilot lamp 33. For example, assuming that pilot lamp 33 has the spread angle of about 25°, pilot lamp 33 is arranged such that the optical axis of pilot lamp 33 is oriented towards the horizontal direction or such that the optical axis is inclined upwards by about 25° or less with respect to the horizontal direction.

In the example of FIG. 18, pilot lamp 33 is arranged on the obliquely lower side of optical pattern region 36 such that the optical axis is oriented towards the substantially horizontal direction. When pilot lamp 33 spreads horizontally and vertically by about 25° around the optical axis, desirably pilot lamp 33 is arranged such that optical pattern region 36 falls within a vertical range of 0° to 25° and a horizontal range of ±25° based on the optical axis of pilot lamp 33. Optical pattern 82 is a triangular shape in section or a pyramid-like prism, and optical pattern 82 is formed into the arc shape around the place where the light is incident to optical pattern region 36 when viewed from above (see FIG. 6A). As illustrated in FIG. 18, optical pattern 82 is designed such that the light incident from obliquely below is refracted and output in the direction substantially perpendicular to the top surface of top panel 40*a*.

When the light emitted from pilot lamp 33 is incident to optical pattern 82 from obliquely below, the light incident to optical pattern 82 is refracted upwards by optical pattern 82, and output towards the direction substantially perpendicular to the top surface of top panel 40*a*. As a result, optical pattern region 36 of top panel 40*a* emits the light in the planar state. In the fourth embodiment, desirably optical pattern region 36 has the area of at least ⅕ times as large as that of top panel 40*a*.

In relay 81 of the fourth embodiment, because the top surface of top panel 40*a* emits the light in the planar state, the light is easily seen from all directions thus improving visibility. Particularly, in the case that a plurality of relays 81 are arrayed, the light is not interrupted by adjacent relay 81, the relay 81 emitting the light is not confused with adjacent relay 81, and thus the relay 81 emitting the light is easily distinguishable.

Modification of Fourth Embodiment

Figure 19:
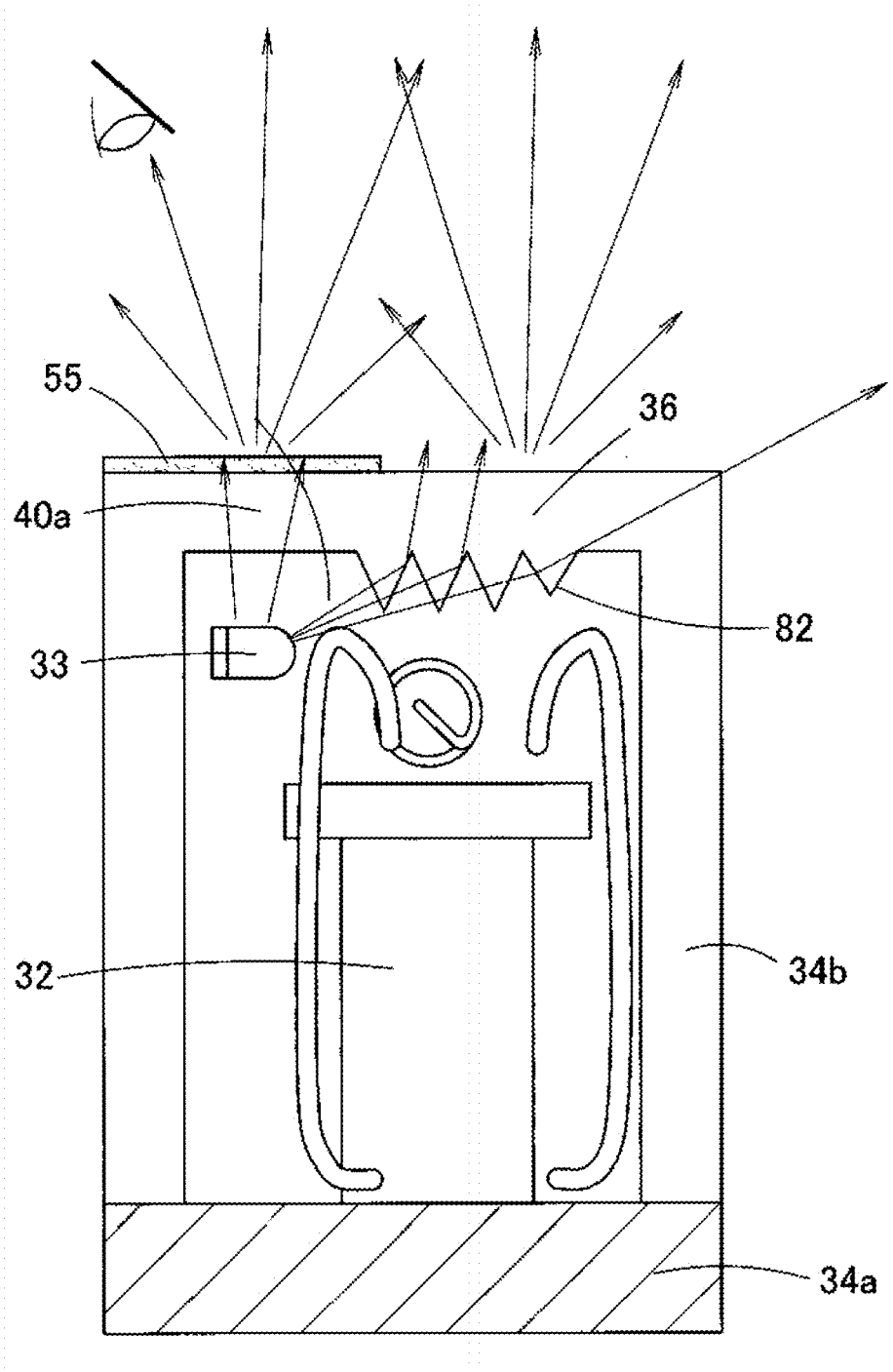
FIG. 19 is a schematic sectional view illustrating a relay according to a first modification of the fourth embodiment.

FIG. 19 is a schematic sectional view illustrating a relay according to a first modification of the fourth embodiment. In the relay of the first modification of the fourth embodiment, diffusion optical system 55 is provided on the top surface of top panel 40*a* above pilot lamp 33 in relay 81 of the fourth embodiment. Therefore, the light leaking upwards from pilot lamp 33 is diffused by diffusion optical system 55 and seen from all directions, thereby the visibility of the operation display becomes better in the relay.

Figure 20:
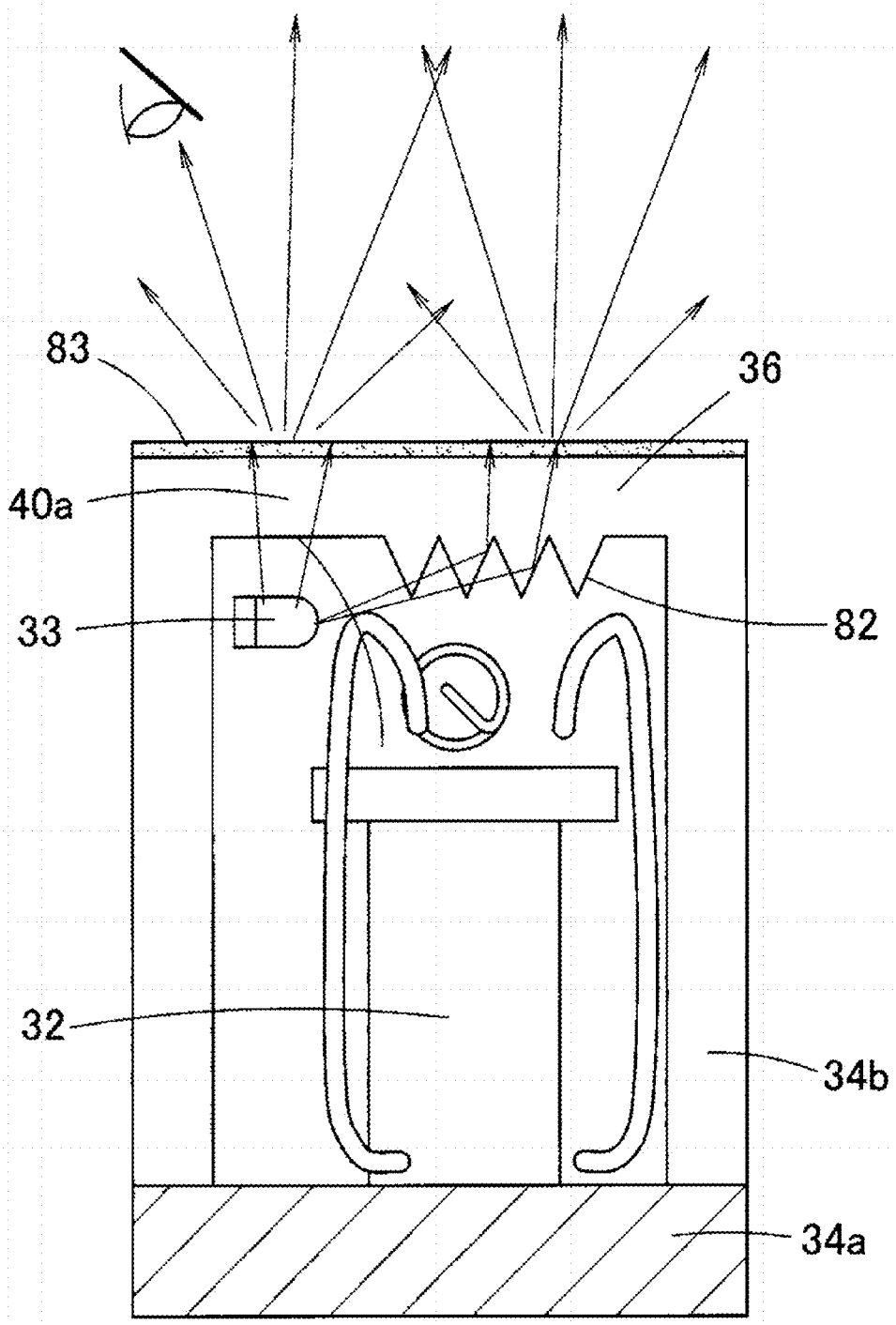
FIG. 20 is a schematic sectional view illustrating a relay according to a second modification of the fourth embodiment.

FIG. 20 is a schematic sectional view illustrating a relay according to a second modification of the fourth embodiment. In the relay of the second modification of the fourth embodiment, diffusion optical system 83 (similar to diffusion optical system 55) is provided on the whole top surface of top panel 40*a* in relay 81 of the fourth embodiment. Therefore, the light output from optical pattern region 36 is diffused by diffusion optical system 83, the light leaking upwards from pilot lamp 33 is diffused by diffusion optical system 55, and the light emission of the whole top surface of top panel 40*a* is seen from all directions, thereby the visibility of the operation display becomes better in the relay.

Figure 21:
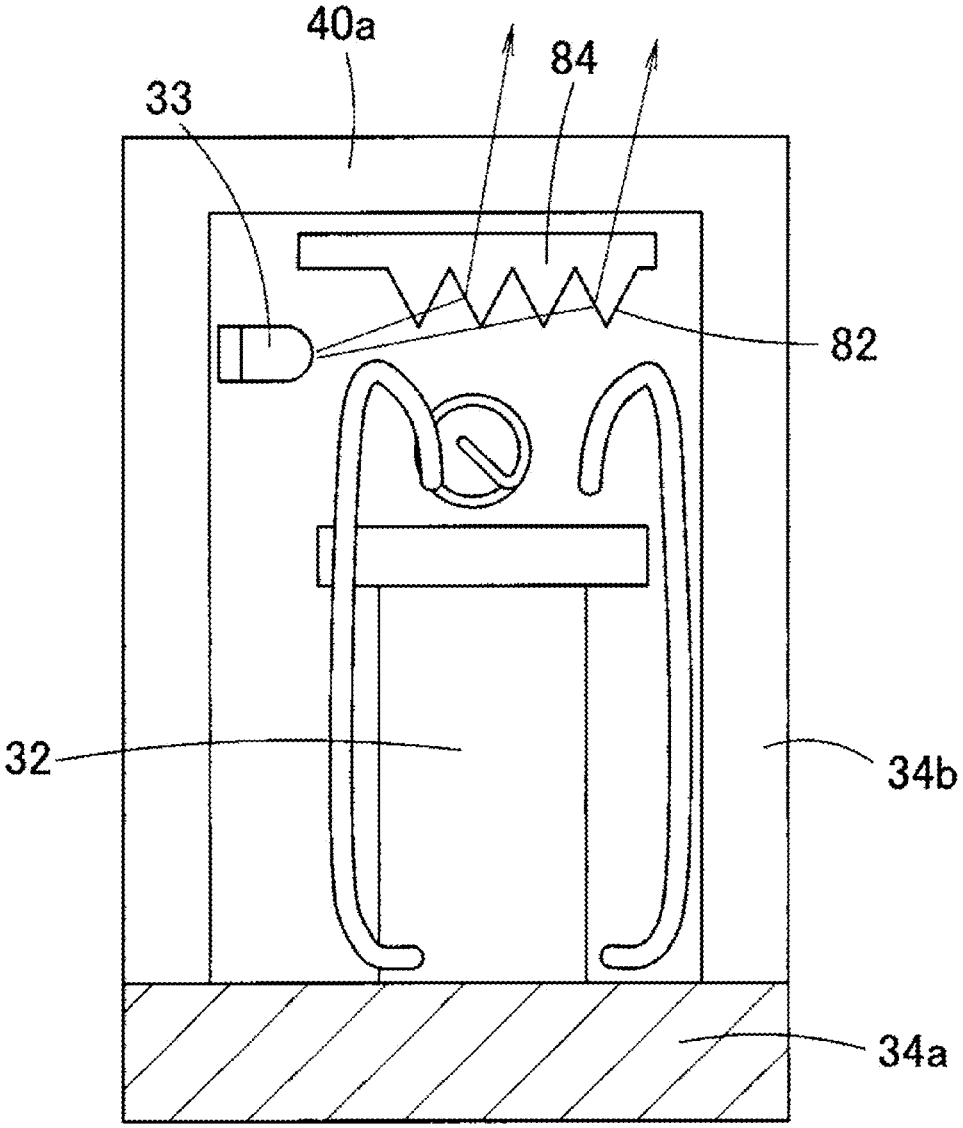
FIG. 21 is a schematic sectional view illustrating a relay according to a third modification of the fourth embodiment.

As illustrated in FIG. 21, prism sheet 84 in which optical pattern 82 is formed may be arranged below top panel 40*a*.

Fifth Embodiment

Figure 22:
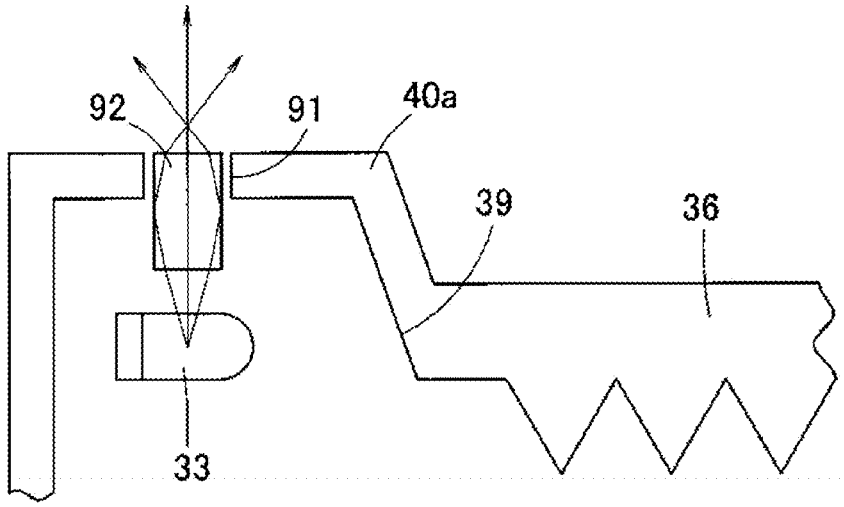
FIG. 22 is a schematic sectional view illustrating a part of a relay according to a fifth embodiment of the present invention.

FIG. 22 is a schematic sectional view illustrating a method for handling the light leaking upwards from horizontally-installed pilot lamp 33. In a fifth embodiment, through-hole 91 is made in top panel 40*a* above pilot lamp 33, and a columnar light guide, namely, columnar member 92 made of a transparent resin is inserted in through-hole 91. In the configuration of the fifth embodiment, when the light exiting upwards from pilot lamp 33 is incident to columnar member 92, the light is reflected by an outer circumferential surface of columnar member 92, and output from the top surface of columnar member 92. Because the light output from the top surface of columnar member 92 spreads outwards, the light transmitted through columnar member 92 is easily recognized from a lateral direction.

Modification of Fifth Embodiment

Figure 23A:
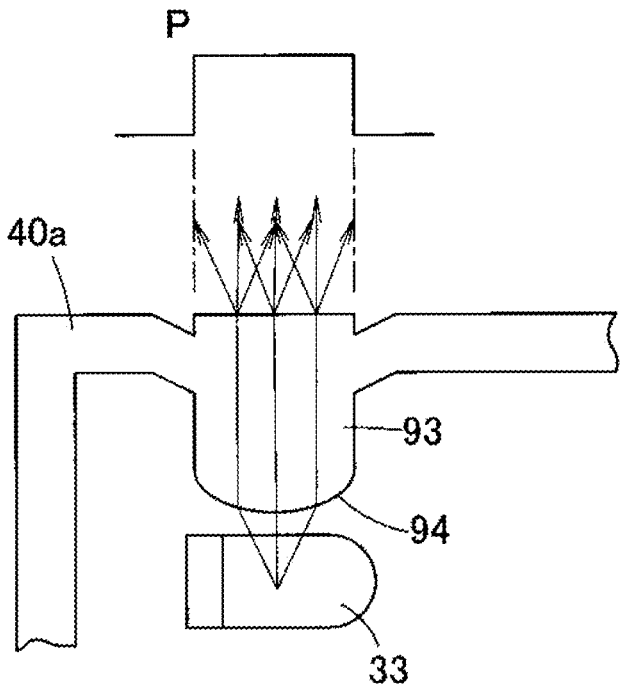
FIG. 23A is a schematic view illustrating a partial section and a light intensity distribution of a relay according to a first modification of the fifth embodiment.

FIG. 23A illustrates a relay according to a first modification of the fifth embodiment. In the first modification of the fifth embodiment, columnar member 93 made of the transparent resin is molded and made integral with top panel 40*a*. The bottom surface of columnar member 93 is molded into a spherical shape to provide convex lens 94, and the top surface of columnar member 93 is subjected to a light diffusion treatment. The light incident from the bottom surface of columnar member 93 is formed into parallel light by convex lens 94, passes through columnar member 93, and is diffused by the top surface of columnar member 93. As a result, light intensity P increases at the top surface of columnar member 93, and the top surface of columnar member 93 uniformly emits the light. In the first modification of the fifth embodiment, because columnar member 93 is molded and made integral with top panel 40*a*, a trouble of assembling columnar member 93 in top panel 40*a* is eliminated.

Figure 23B:
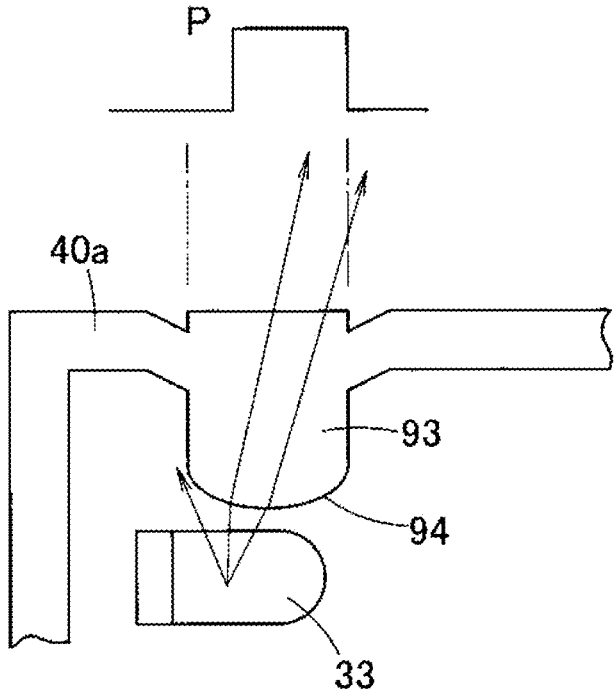
FIG. 23B is a schematic view illustrating a state and the light intensity distribution of the relay of the first modification in FIG. 23A when a pilot lamp is displaced.

However, in the structure of FIG. 23A, in the case that the position of columnar member 93 is shifted from the position of pilot lamp 33, the light is easily seen in a certain direction but hardly seen on the opposite side as illustrated in FIG. 23B.

Figure 24A:
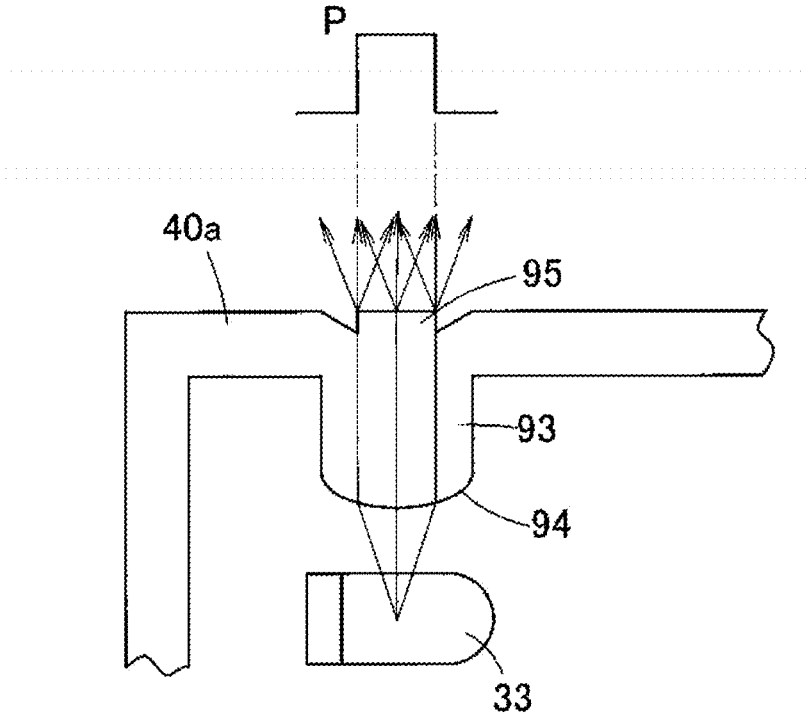
FIG. 24A is a schematic view illustrating a partial section and a light intensity distribution of a relay according to a second modification of the fifth embodiment.
Figure 24B:
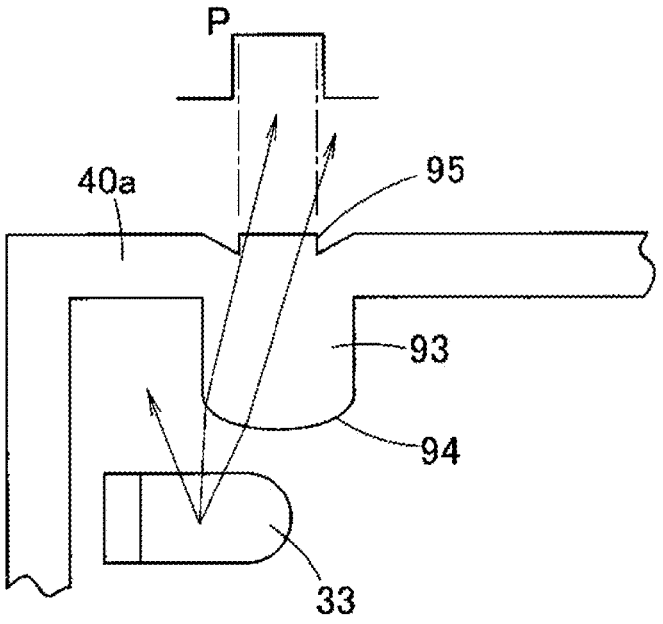
FIG. 24B is a schematic view illustrating a state and the light intensity distribution of the relay of the second modification in FIG. 24A when the pilot lamp is displaced.

FIG. 24A illustrates a relay according to a second modification of the fifth embodiment, namely, an improved example of the first modification. In the second modification of the fifth embodiment, columnar projection 95 having a diameter smaller than that of columnar member 93 is provided on the top surface of columnar member 93, and the top surface of columnar projection 95 is subjected to the light diffusion treatment. According to the configuration, even if the position of columnar member 93 is shifted from the position of pilot lamp 33 as illustrated in FIG. 24B, a light intensity distribution of the light output from columnar projection 95 is hardly shifted, and the light is uniformly seen from all directions.

Sixth Embodiment

Figure 25:
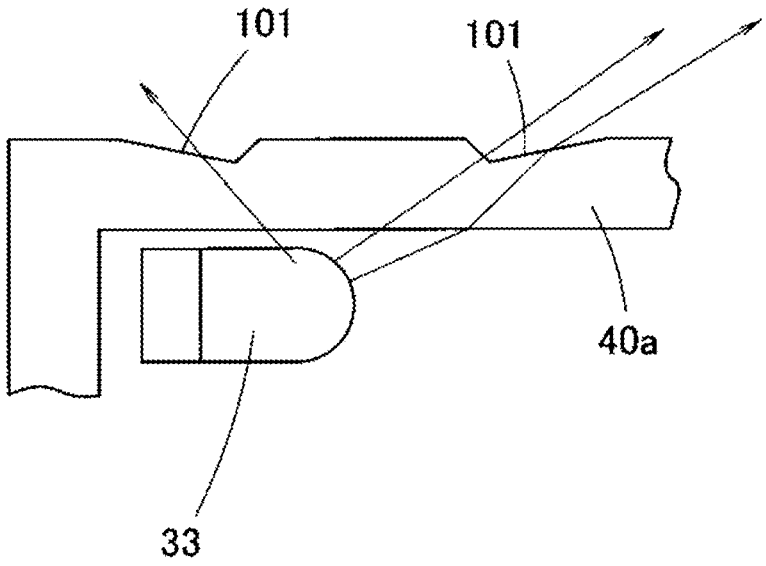
FIG. 25 is a schematic sectional view illustrating a part of a relay according to a sixth embodiment of the present invention.

FIG. 25 is a schematic sectional view illustrating another method for handling the light leaking upwards from horizontally-installed pilot lamp 33. In a sixth embodiment, circular V-groove 101 is formed around an axis, which passes through a substantial center of the light emission of pilot lamp 33 and is perpendicular to the top surface of top panel 40*a*. A depth of circular V-groove 101 ranges from about 0.2 mm to about 1.5 mm. When circular V-groove 101 is provided above pilot lamp 33, the light passing through V-groove 101 is radiated in a direction different from that of the light passing through the flat top surface of the top panel in which V-groove 101 is not formed. Therefore, because V-groove 101 is formed in top panel 40*a*, the light is emitted upwards in a wide angle range from pilot lamp 33, and the light can be recognized in a wide range to enhance the visibility of the operation display light.

Figure 26:
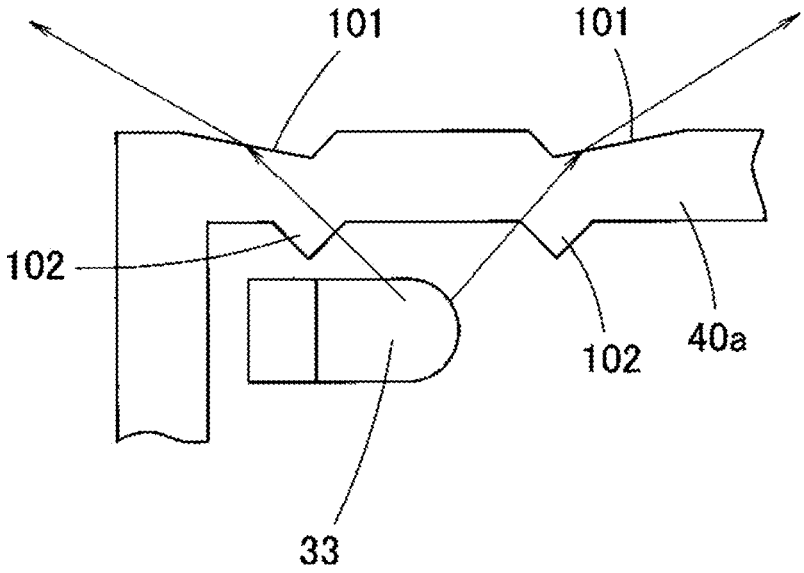
FIG. 26 is a schematic view illustrating a partial section of a relay according to a first modification of the sixth embodiment.

As illustrated in FIG. 26, circular prism 102 may be provided in a bottom surface of top panel 40*a* below V-groove 101. A height of circular prism 102 ranges from about 0.2 mm to about 1.5 mm. When circular prism 102 is provided in the bottom surface of top panel 40*a* in addition to V-groove 101 provided in the top surface of top panel 40*a*, the light can be radiated when refracted in various directions, and the light can be recognized in the wider range to further enhance the visibility of the operation display light.

Figure 27:
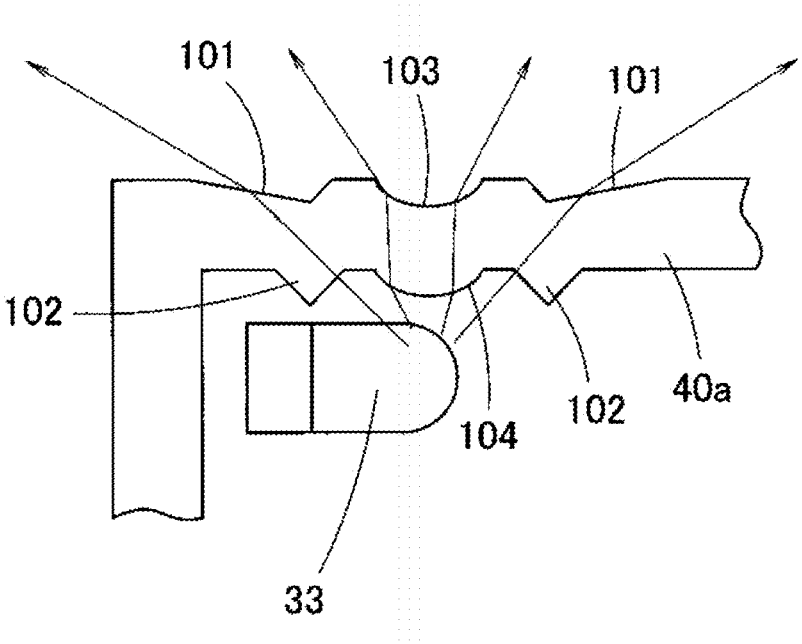
FIG. 27 is a schematic view illustrating a partial section of a relay according to a second modification of the sixth embodiment.

As illustrated in FIG. 27, concave curve 103 having a concave lens shape may be provided in the center of V-groove 101 in the top surface of top panel 40*a* and convex curve 104 having a convex lens shape may be provided in the center of circular prism 102 in the bottom surface of top panel 40*a*. The light can be emitted in various directions from pilot lamp 33 because concave curve 103 and convex curve 104 are provided in the top and bottom surfaces of top panel 40*a*, respectively. Therefore, the light can be recognized in the wider range to further enhance the visibility of the operation display light.

Optical Pattern Having Different Shape

Figure 28:
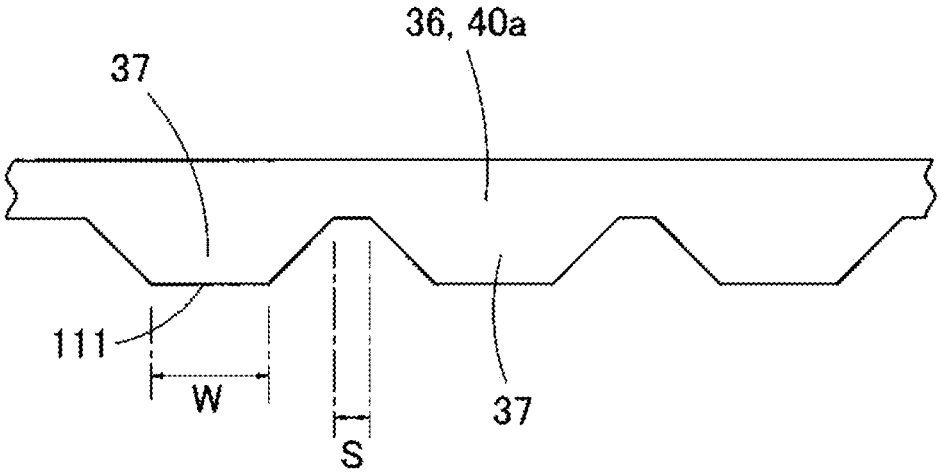
FIG. 28 is a sectional view illustrating an optical pattern having a different shape.

In the above embodiments, optical pattern 37 has the triangular prism shape in section or the pyramid shape. However, optical pattern 37 is not limited to the triangular prism shape in section or the pyramid shape. For example, FIG. 28 illustrates optical pattern 37 having a trapezoidal shape in cross-section. For example, optical pattern 37 may have a truncated square pyramid shape. Preferably a leading end surface of optical pattern 37 having the truncated square pyramid shape has a width W of several tens of micrometers or less. Preferably gap S between optical patterns 37 is less than or equal to several tens of micrometers. Optical pattern 37 having the truncated square pyramid shape can be used in both the light guide type in FIGS. 7 to 17 and the projection type in FIGS. 18 to 21.

An object of an embodiment of the present invention is to improve the visibility of the pilot lamp incorporated in the relay.

In accordance with a first aspect of an embodiment of the present invention, in a relay in which a relay body and a light source are incorporated in a case, the light source emitting light in conjunction with operation of the relay body, a light guide is provided inside an outer surface of the case, the light guide is configured to take in the light emitted from the light source, to guide the light to a portion parallel to a top panel of the case, and to spread the light in the portion parallel to the top panel, and an optical pattern is provided in at least one of a top surface and a bottom surface of the portion parallel to the top panel, the optical pattern is configured to output, the light guided in the light guide to the portion parallel to the top panel, to outside the case from the top surface of the top panel.

For example, the optical pattern may be a projection or a recess, the projection or the recess being formed in a prism shape.

According to the relay of the first aspect, because a predetermined region in the top panel of the relay can emit the light in a planar state, the light used to display the operation of the relay can be recognized from all directions, and the visibility of source light (pilot lamp) of the relay is improved. Even if the plurality of relays is arrayed, the light emitted from the light source is hardly interrupted by the adjacent relay, and the visibility is hardly degraded. Additionally, the risk that the light emitted from the light source is not seen due to the disturbance light is decreased because the relatively wide area of the top panel of the relay emits the light.

In the relay in accordance with the first aspect, preferably the optical pattern is arranged in a concentric circle around a place, in which the light is incident to a region where the optical pattern is formed when viewed from a direction perpendicular to the top panel. Accordingly, in the case that the light source is a small light source (point light source) such as an LED, the light emitted from the light source is reflected by the optical pattern, which allows the light to be efficiently output in the direction perpendicular to the top panel, which is outside the case and the top panel.

In the relay in accordance with the first aspect, preferably the optical pattern outputs the light to outside the case from the top surface of the top panel by totally reflecting the light guided in the light guide. Accordingly, the use of the total reflection eliminates necessity of a reflecting tape, and cost can be reduced.

In the relay in accordance with the first aspect, preferably the light guide is provided in the case, and the optical pattern is provided in a bottom surface of the top panel. Accordingly, the case can be used as the light guide, and the optical pattern is provided in the top panel of the case, so that enlargement of the relay can be avoided.

In the relay in accordance with the first aspect, the light source may be accommodated in a recess formed in the bottom surface of the top panel, and the light horizontally emitted from the light source may be incident to the top panel from a sidewall surface of the recess, for the light emitted from the light source to be incident to the case (light guide). Alternatively, the light source may be arranged below the top panel, a protrusion including a light incident surface may be projected from the bottom surface of the top panel at a position opposite to the light source, and the light emitted from the light source may be incident to the top panel from the light incident surface of the protrusion.

In the relay in accordance with the first aspect, an orientation and a position of the light source can freely be designed. For example, an inclined reflecting surface may be formed in the top surface of the case, the light emitted upward from the light source may be incident to the top panel, and the light may be guided along the top panel by reflecting the light incident to the top panel using the reflecting surface. Alternatively, a first reflecting surface inclined with respect to a surface perpendicular to a thickness direction of a sidewall plate of the case may be provided in an outer surface of the sidewall plate of the case, an inclined second reflecting surface may be formed in a corner portion between the top surface and a side surface of the case, the light horizontally emitted from the light source may be incident to the sidewall plate, the light may be guided along the sidewall plate by reflecting the light incident to the sidewall plate using the first reflecting surface, and the light may be guided along the top panel by reflecting the light using the second reflecting surface.

In the relay in accordance with the first aspect, preferably the light guide is a light guide plate that is arranged opposite to the bottom surface of the top panel, the light source is arranged opposite to the light incident surface of the light guide plate, and the optical pattern is provided in one of a top surface and a bottom surface of the light guide plate. It is only necessary to insert the light guide plate in which the optical pattern is provided in the case. Accordingly, versatility is enhanced.

In the relay in accordance with the first aspect, preferably a transparent operation checking window is formed in the top panel in a region outside the region, where the optical pattern is provided, when viewed from the direction perpendicular to the top panel. Accordingly, the inside of the relay is seen through the operation checking window, so that the operating state of the relay can be checked.

In the relay in accordance with the first aspect, preferably a plurality of types of optical patterns are formed in the light guide, the optical patterns are configured to reflect the light guided in the light guide in different directions. Accordingly, when a character, a numerical character, or a mark is drawn by one of the optical patterns, the corresponding character, numerical character, or mark can brightly be displayed only when viewed from a specific direction.

In accordance with a second aspect of the embodiment of the present invention, in a relay in which a relay body and a light source are incorporated in a case, the light source emitting light in conjunction with operation of the relay body, an optical pattern is arranged below a top surface of a top panel of the case, the optical pattern is configured to refract the light incident from a bottom surface side and to output the light to outside the case from the top surface of the top panel, and the light source is arranged below the optical pattern such that an optical axis of the light source is oriented toward a horizontal direction or a direction looking up to the top panel from the horizontal direction within a spread angle of the light source.

According to the relay of the second aspect, because the predetermined region in the top panel of the relay can emit the light in the planar state, the light used to display the operation of the relay can be recognized from all directions, and the visibility of the source light (pilot lamp) of the relay is improved. Even if the plurality of relays is arrayed, the light emitted from the light source is hardly interrupted by the adjacent relay, and the visibility is hardly degraded. Additionally, the risk that the light emitted from the light source is not seen due to the disturbance light is decreased because the relatively wide area of the top panel of the relay emits the light.

In the relay in accordance with the second aspect, preferably the optical pattern is provided in a bottom surface of the top panel. It is not necessary to use the additional member for providing the optical pattern. Accordingly, downsizing of the relay can be achieved and the cost can be reduced.

In the relay in accordance with the first and second aspects, preferably, in the top panel, the light is output to outside the case from a region having an area of at least ⅕ times as large as that of the top panel. When the light emission area is smaller than ⅕ times the area of the top panel, possibly the visibility of the light emitted from the light source is degraded depending on a use state or the disturbance light.

In the relay in accordance with the first and second aspects, a diffusion optical system may be formed in the top panel in a region corresponding to the optical pattern. Accordingly, an output direction of the light output from the top panel is spread, so that the light emitted from the light source can be recognized in the wider range to improve the visibility.

In the relay in accordance with the first and second aspects, the diffusion optical system or a columnar light guide may be provided in the top panel above the light source, when the light source is arranged below the top panel and the optical axis of the light source is parallel to the top panel. Accordingly, the light leaking upward from the light source can be used as the operation checking light, and the relay can look more brightly.

The unit solving the problem in the embodiment of the present invention has the feature in which the above constituents are combined, and various variations can be made by the combination of the constituents.

What is claimed is:

1. A relay in which a relay body and a light source are incorporated in a case, the light source emitting light in conjunction with operation of the relay body, wherein a light guide is provided inside an outer surface of the case, the light guide is configured to take in the light emitted from the light source, to guide the light to a portion parallel to a top panel of the case, and to spread the light in the portion parallel to the top panel, and an optical pattern is provided in at least one of a top surface and a bottom surface of the portion parallel to the top panel, the optical pattern is configured to output, the light guided in the light guide to the portion parallel to the top panel, to outside the case from a top surface of the top panel.

2. The relay according to claim 1, wherein, in the top panel, the light is output to outside the case from a region having an area of at least ⅕ times as large as that of the top panel.

3. The relay according to claim 1, wherein the optical pattern is a projection or a recess, the projection or the recess being formed in a prism shape.

4. The relay according to claim 1, wherein the optical pattern is arranged in a concentric circle around a place, in which the light is incident to a region where the optical pattern is formed when viewed from a direction perpendicular to the top panel.

5. The relay according to claim 1, wherein the optical pattern outputs the light to outside the case from the top surface of the top panel by totally reflecting the light guided in the light guide.

6. The relay according to claim 1, wherein the light guide is provided in the case, and the optical pattern is provided in a bottom surface of the top panel.

7. The relay according to claim 6, wherein the light source is accommodated in a recess formed in the bottom surface of the top panel, and the light horizontally emitted from the light source is incident to the top panel from a sidewall surface of the recess.

8. The relay according to claim 6, wherein the light source is arranged below the top panel, a protrusion comprising a light incident surface is projected from the bottom surface of the top panel at a position opposite to the light source, and the light emitted from the light source is incident to the top panel from the light incident surface of the protrusion.

9. The relay according to claim 6, wherein an inclined reflecting surface is formed in a top surface of the case, the light emitted upwards from the light source is incident to the top panel, and the light is guided along the top panel by reflecting the light incident to the top panel using the reflecting surface.

10. The relay according to claim 6, wherein a first reflecting surface inclined with respect to a surface perpendicular to a thickness direction of a sidewall plate of the case is provided in an outer surface of the sidewall plate of the case, an inclined second reflecting surface is formed in a corner portion between the top surface and a side surface of the case, the light horizontally emitted from the light source is incident to the sidewall plate, the light is guided along the sidewall plate by reflecting the light incident to the sidewall plate using the first reflecting surface, and the light is guided along the top panel by reflecting the light using the second reflecting surface.

11. The relay according to claim 1, wherein the light guide is a light guide plate that is arranged opposite to a bottom surface of the top panel, the light source is arranged opposite to the light incident surface of the light guide plate, and the optical pattern is provided in one of a top surface and a bottom surface of the light guide plate.

12. The relay according to claim 1, wherein a transparent operation checking window is formed in the top panel in a region outside a region where the optical pattern is provided, when viewed from the direction perpendicular to the top panel.

13. The relay according to claim 1, wherein a plurality of types of optical patterns are formed in the light guide, the optical patterns are configured to reflect the light guided in the light guide in different directions.

14. The relay according to claim 1, wherein a diffusion optical system is formed in the top panel in a region corresponding to the optical pattern.

15. The relay according to claim 1, wherein the light source is arranged below the top panel and the optical axis of the light source is parallel to the top panel, and the diffusion optical system is formed in the top panel above the light source.

16. The relay according to claim 1, wherein the light source is arranged below the top panel and the optical axis of the light source is parallel to the top panel, and a columnar light guide is provided in the top panel above the light source.

* * * * *